US005095719A

United States Patent [19]

Philip

[11] Patent Number: 5,095,719

[45] Date of Patent: Mar. 17, 1992

[54] METHOD AND CIRCULAR KNITTING APPARATUS FOR KNITTING INTARSIA DESIGN FABRIC

[76] Inventor: Morris Philip, c/o Philip Knitting Mills, 26 Bruckner Blvd., Bronx, N.Y. 10454

[21] Appl. No.: 466,112

[22] Filed: Jan. 16, 1990

Related U.S. Application Data

[63] Continuation-in-part of Ser. No. 414,739, Sep. 27, 1989, abandoned, which is a continuation of Ser. No. 323,060, Mar. 14, 1989, abandoned, which is a continuation of Ser. No. 217,513, Jul. 11, 1988, abandoned, which is a continuation of Ser. No. 75,223, Jul. 17, 1987, abandoned, which is a continuation of Ser. No. 872,636, Jun. 10, 1986, abandoned, which is a continuation of Ser. No. 682,246, Dec. 17, 1984, abandoned.

[51] Int. Cl.[5] ..... D04B 9/00

[52] U.S. Cl. ..... 66/8; 66/125 R

[58] Field of Search ..... 66/5, 6, 8, 49, 51, 66/125 R, 135, 141

[56] References Cited

U.S. PATENT DOCUMENTS

| | | | |
|---|---|---|---|
| 585,496 | 6/1897 | Winlund | 66/51 |
| 1,499,144 | 6/1924 | Barth | 66/8 |
| 1,594,426 | 8/1926 | Mankin | 66/49 |
| 1,690,729 | 11/1928 | Jones | 66/141 X |
| 1,843,641 | 2/1932 | Jones | 66/51 |
| 1,951,102 | 3/1934 | Mills | 66/41 |

FOREIGN PATENT DOCUMENTS

| | | | |
|---|---|---|---|
| 95 | of 1900 | United Kingdom | 66/5 |

*Primary Examiner*—Werner H. Schroeder
*Assistant Examiner*—John J. Calvert
*Attorney, Agent, or Firm*—Armstrong, Nikaido, Marmelstein, Kubovcik and Murray

[57] ABSTRACT

A method and apparatus for knitting intarsia design jersey knit fabric on a circular knitting machine capable of knitting single jersey fabric. The method includes the steps of raising groups of contiguous needles on the needle cylinder, drawing down, one after the other in a first direction, the raised needles to form a new stitch loop in the hook of each needle as it is drawn down and to shed the old stitch loop into the jersey fabric being knitted, while drawing down the needles of the first group of needles in the first direction, raising needles of the next group of needles and drawing down, one after the other the needles of such next group after all of the needles of the first group are drawn down until all of the needles are drawn down, new stitch loops are formed and the old stitch loops are shed, continuing the movement in the first direction until the needles are cleared and the yarn feed is repositioned and then reversing the direction of movement, the raising of the needle groups, the drawing down and the clearing of the needles and the yarn feed is repositioned, cycle after cycle, until the knitting is completed. The apparatus includes pushers for raising the needles, a knitting cam for drawing the raised needles, one after the other, down, yarn feeds for feeding yarn to the raised needles, pusher cams for raising and lowering the pushers, a reciprocating drive for reciprocating the knitting cam, back and forth, around the cylinder to draw the needles down after they are raised by the pushers, a drive for repositioning the yarn feeds and for reversing the direction of reciprocation of the knitting cam after the raised needles of a first and a next group of needles have been raised and drawn down, the knitting cam has cleared such needles and the yarn feeds have been repositioned.

18 Claims, 15 Drawing Sheets

METHOD AND CIRCULAR KNITTING APPARATUS FOR KNITTING INTARSIA DESIGN FABRIC

This application is a continuation-in-part of application Ser. No. 414,739, filed Sept. 27, 1989, now abandoned; in turn a continuation of Ser. No. 323,060, filed Mar. 14, 1989, now abandoned; a continuation of Ser. No. 217,513, filed July 11, 1988, now abandoned; a continuation of Ser. No. 075,223, filed July 17, 1987, now abandoned; a continuation of 872,636, filed June 10, 1986, now abandoned; in turn, a continuation of 682,246, filed Dec. 17, 1984, now abandoned, and relates to a method and apparatus for knitting jersey fabric having a multi-color intarsia design and, more particularly to a method and apparatus for controlling the needle movement on a knitting machine, especially a circular knitting machine capable of knitting single jersey fabric, for knitting such intarsia design jersey fabric.

Circular knitting machines and flat knitting machines are both used for knitting jersey fabric and jersey and rib fabric. Circular knitting machines have many times more feeds and can be run at substantially higher speed than can flat knit machines. Thus, the rate of production is much higher with the circular knit machine than with the flat machine. The cost of fabric knitted with the circular machine is much less than with the flat machine.

In circular knitting machines, the needles are spaced in grooves around the cylinder. Each needle, when knitting, is raised to a cleared position and drawn down to form a stitch. When the needle is raised, the needle latch is opened by the stitch loop that was in the needle hook before the needle was raised. As the needle was raised, the stitch loop in the needle hook was held down. As the needle is drawn down, the needle hook engages the new yarn being fed to the needle by the yarn feed. The needle latch is closed by the old loop on the needle as the old loop slips over the latch. The new yarn engaged in the needle hook is drawn through the old stitch loop on the needle to form a new stitch. The old stitch loop, held down as the needle is raised is shed from the needle when the needle is drawn down. The needles are progressively raised and drawn down by cams, one needle after the other, as the machine rotates. Depending upon the cam length, a plurality of needles at the front of the cam in the direction of machine rotation are in progressive positions of being raised while a plurality of needles at the back of the cam are in progressive positions of being drawn down. By providing the machine with a multiplicity of circumferentially spaced cams, with an equal number of yarn feeds, a substantial length of fabric can be knitted during each revolution of the machine.

The cylinder, on a plain jersey circular machine, and the cylinder and dial, on a jersey and rib circular machine, may be rotated while the cams and yarn feeds are held stationary, or the cylinder or cylinder and dial, as the case may be, might be held stationary while the cams and yarn feeds are rotated. The fabric being knitted is rotated with the cylinder or is held stationary depending on whether the cylinder is rotating or stationary.

Attempts, heretofore, to knit plain single knit jersey fabric, without floats, on a circular knitting machine with color design, such as intarsia color designs, knitted into the fabric have been unsuccessful. Knit jersey fabric, with floats, makes the fabric much heavier. While such intarsia design fabrics, of plain single knit jersey knit fabric without floats can be knitted on flat knit machines with the design on both sides of the fabric, when knitted on a circular knitting jersey machine, the color yarns, when they do not appear in the design on the front of the fabric, remain in the back of the fabric as floats, are threaded to the back of the fabric or must be trimmed, in some fashion from the fabric back. The color yarn in the back of the fabric as floats or threaded to the fabric back detracts for the appearance and acceptance of such circular knit fabric. Trimming the color yarn from the back of the fabric must be accomplished with care so as not to damage or weaken the fabric. Furthermore, trimming increases fabric costs.

Apart from the appearance and acceptance of such knit-in design multi-color fabric, the trimming of the color yarn from the back of the fabric increased fabric costs, and the like, the methods and apparatus most commonly employed for circular knitting such knit-in design fabric on circular knitting machines has been complicated and relatively expensive. In the methods and apparatus heretofore employed for circular knitting multi-color knit-in design fabric, other than color stripes, the needles to knit the design are selected by a so-called jacquard technique. The selected needles change as knitting progresses and as the design changes. Such jacquard technique employs needle jacks and perforated cards, pattern drums and discs, punched metal tapes and pattern drums, or photosensitive electronic tapes to control the needle jacks. Such jacks and controls add to the size and cost of the apparatus and increase costs in the practice of the jacquard technique.

In the instant invention, it has been discovered that the problems heretofore encountered in knitting color design intarsia fabrics and fabrics having multi-color knit-in geometric designs on plain jersey circular knitting machines can be overcome to produce a fabric having color design on both the back and front of the fabric. This is accomplished in the instant invention by moving the needles and yarn feeds in new and novel manners and by reciprocating the knitting cams, first in one direction and then in the opposite direction, with respect to the cylinder and needles to knit the fabric.

The needles, in the instant invention, are divided into groups of contiguous sequential needles. The groups of needles are alternately advance, or raised, on the cylinder. The advanced, or raised, needles in the group are each in sequence, one after the other, drawn down by a knitting cam. As the needles of the advanced or raised group of needles are being drawn down by the knitting cam, the sequential needles in the group next to be knitted by the cam are being simultaneously raised.

One knitting cam is provided for each pair of sequential needle groups. The knitting cams are spaced around the cylinder and are reciprocated, back and forth, around the cylinder. A yarn feed is provided at each knitting cam position and is repositioned with respect of the needles and knitting cam it is feeding at the end of the reciprocation of the knitting cams in each direction so as to engage the needle hooks as the needles are raised and drawn down by the knitting cams moving in the opposite direction. The cam faces of the knitting cams, in the opposite direction of knitting cam reciprocation, are identical. Thus, in either direction of reciprocation of the knitting cams, the raised needles are drawn down in sequence, one after the other, by the knitting cams moving past the needles.

Each group of contiguous sequential needles is provided with a pusher for simultaneously raising the needles in such group on the cylinder. Once raised, the needles in the group are each held in raised position on the cylinder until drawn down by the knitting cam. For reasons which will be more apparent later herein, in the embodiment of the invention described the pushers for the even numbered of the groups of contiguous sequential needles are provided with one actuator, for example, a cam and the pushers for the odd numbered of the groups of needles are provided with a second actuator, for example, a second cam. Once the actuator has advanced or raised the pushers to, in turn, simultaneously raise the needles to the raised position, the actuator and pusher is retracted, As already noted, the needles are held in advanced or raised position until drawn down by the knitting cam.

Each direction of reciprocation of the knitting cam past the raised needles of the needle group with which the knitting cam is associated produces a knitted course. When a knitted course in one direction is completed, the direction of movement of the knitting cams is reversed, the yarn feed is repositioned and the knitting cam is moved in the opposite direction past the advanced or raised needles of the needle groups to produce the next knitted course. Such direction of reciprocation, reversing and reciprocation of the knitting cams in the opposite direction is repeated while the fabric is being knitted. So that the reciprocation of the knitting cams might be reversed, the yarn feeds might be reciprocated and a course be knitted when the knitting cams are reciprocated in the opposite direction, after the knitting cam has past and drawn down the last needle of the groups of advanced of raised needles with which it is associated, the reciprocation of the knitting cam is continued, without knitting, until the knitting cam is past such last needle, the yarn feed has been repositioned, the needles of the last group have been advanced or raised and the stitches thereon have opened the needle latches for the new stitches in the opposite direction of reciprocation of the knitting cam and the pusher retracted to clear the knitting cam. The knitting cam is then reciprocated in the opposite direction past the raised needles, all as more fully described later herein.

The color design fabric knitted in accordance with the method and apparatus of the instant invention may be of two or more colors. The colored yarn, which includes white, is fed by the yarn feed, mounted on the yarn carrier, to the needles in the groups of needles where such color is to appear in the design. As the needles are simultaneously advanced, or raised, and the individually needles in sequence, one after the other, drawn back, or drawn down, by the knitting cam reciprocating, first in one direction and then in the opposite direction, past the raised needles to draw the needles down, the yarn is knitted into the fabric. By racking the cylinder and needles with respect to the yarn carriers, the pushers and pusher actuators and knitting cams, after one or more courses are knitted, the intarsia design being knitted in the fabric with the colored yarn can be progressed diagonally in the fabric. By racking the cylinder and needles and the yarn feeds with respect to the pushers and the knitting cams, all as will be described in more detail later herein, the intarsia design knitted with the colored yarn might be knitted in a diamond pattern, circle or other design figures.

The instant invention and modifications will be more fully described and will be better understood from the following description taken with the appended drawings, in which FIG. 1 is a fragmentary elevation of a portion of the cylinder of a circular knit machine incorporating the apparatus of the invention and particularly adapted to carry out the process of the invention with the portion shown flat, rather than circular, for purposes of illustration and description and wherein the needle bed is on the outer surface of the cylinder with the knitting cams and needle pushers surrounding the cylinder, the view being taken from the outside looking toward the cylinder;

FIG. 1A is an enlarged view, in elevation, of a portion of the cylinder and needles of a prior art conventional circular knitting machine showing the needles , in progressive sequence, as the needles are each raised, one after the other, the needle latch is opened, the opened needle hook engages the yarn and, as the needle is drawn down, a new stitch is drawn through the stitch loop on the needle, the needle latch is closed and the old stitch on the needle is shed and becomes a part of the knitted fabric, all in prior art conventional manner;

FIG. 1B is an enlarged view, in elevation, of a portion of the cylinder and needle arrangement of the apparatus of the instant invention shown in FIG. 1 showing the needles of the first group of needles, as such needles have been raised, the knitting cam has been reciprocated to the left, past the first group of needles to clear such needles, its movement relative to the needles has been reversed, the yarn feed has been repositioned and the knitting cam has commenced movement from left to right toward the first group of needles;

FIG. 1C is an enlarged view, in elevation, similar to FIG. **1*b*** but showing the needles of the first and second groups of needles, with the knitting cam, moving from left to right through the raised needles of the first needle group, the needles to the left of the first group have each, one after the other, been drawn down by the knitting cam, the needle hook of each needle, as the needle is drawn down, has engaged the yarn and formed a new loop, the latch of the needle has closed, a new stitch has been formed, the old stitch has been shed and as the knitting cam progresses toward the right and towards the second needle group, the needles of such second group beginning to rise;

FIG. 1D is an enlarged view, in elevation, similar to FIGS. 1B and 1C showing the needles of the first and second groups of needles but showing the needles of the first group drawn down by the knitting cam, the needles of the second group of needles fully raised and the second needle pusher lowered so as to clear the knitting cam as the knitting cam, continuing to move from left to right, draws the needles of the second needle group down, one after the other, in progression, to engage the yarn, form new stitch loops and shed old stitch loops;

Figure 1:
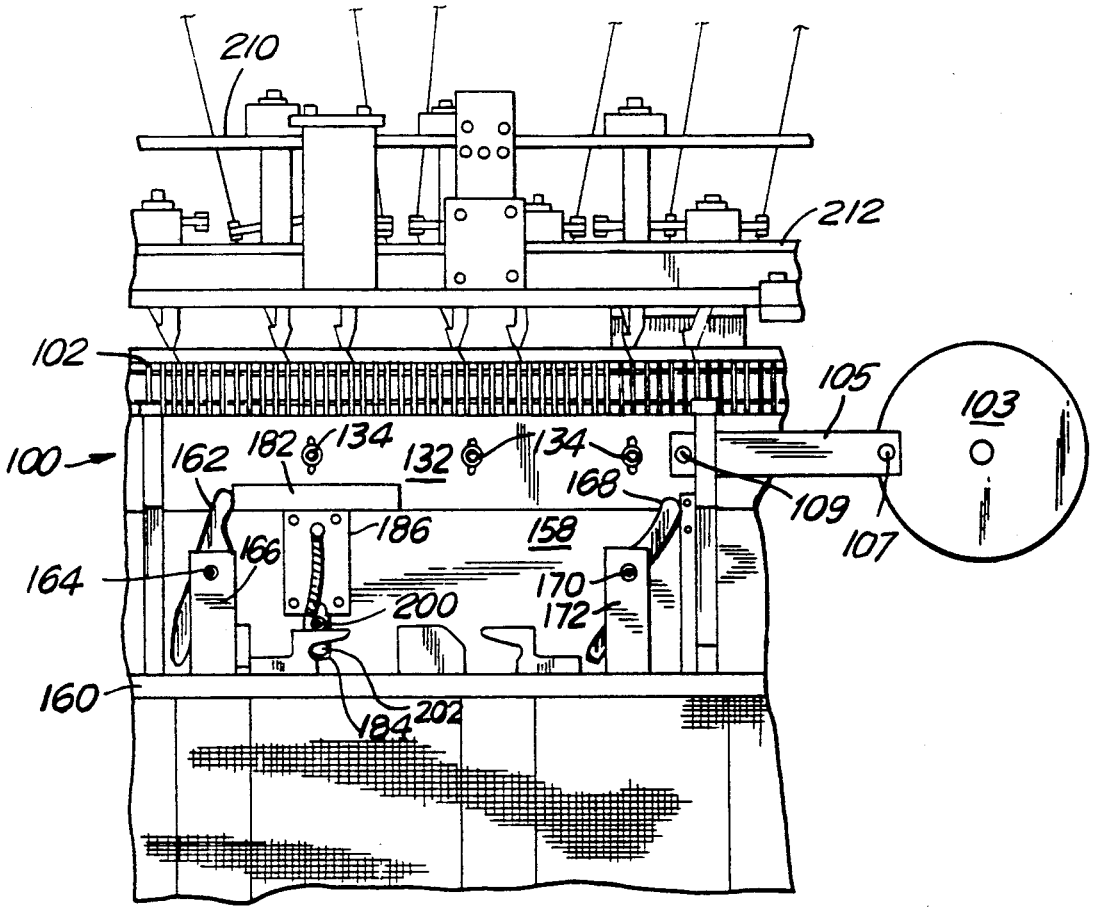
Figure 7:
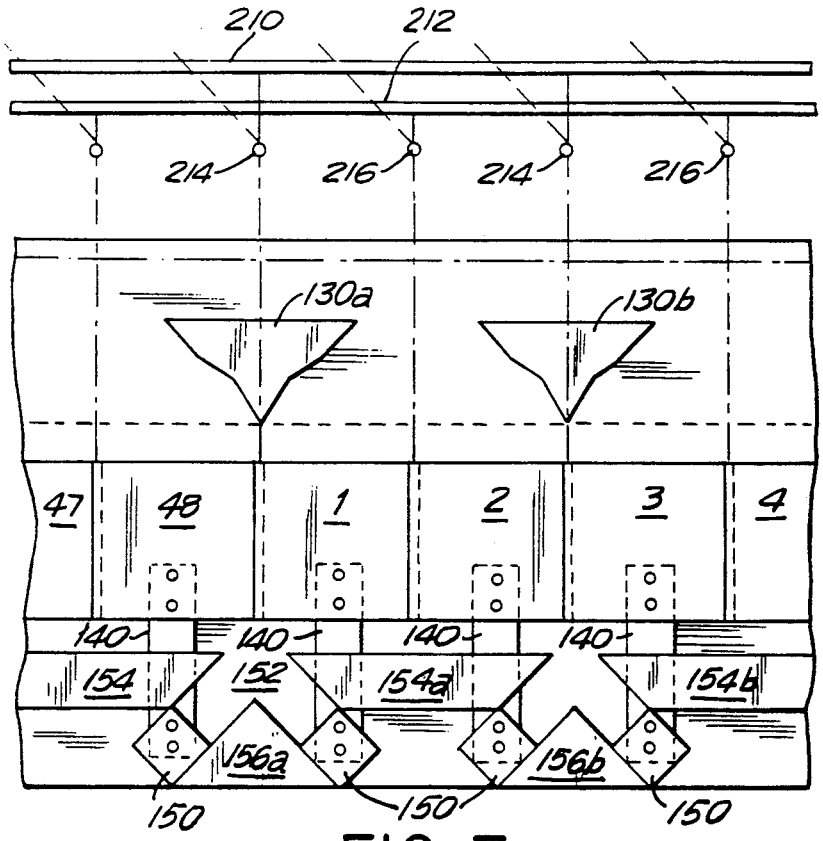
Figure 8:
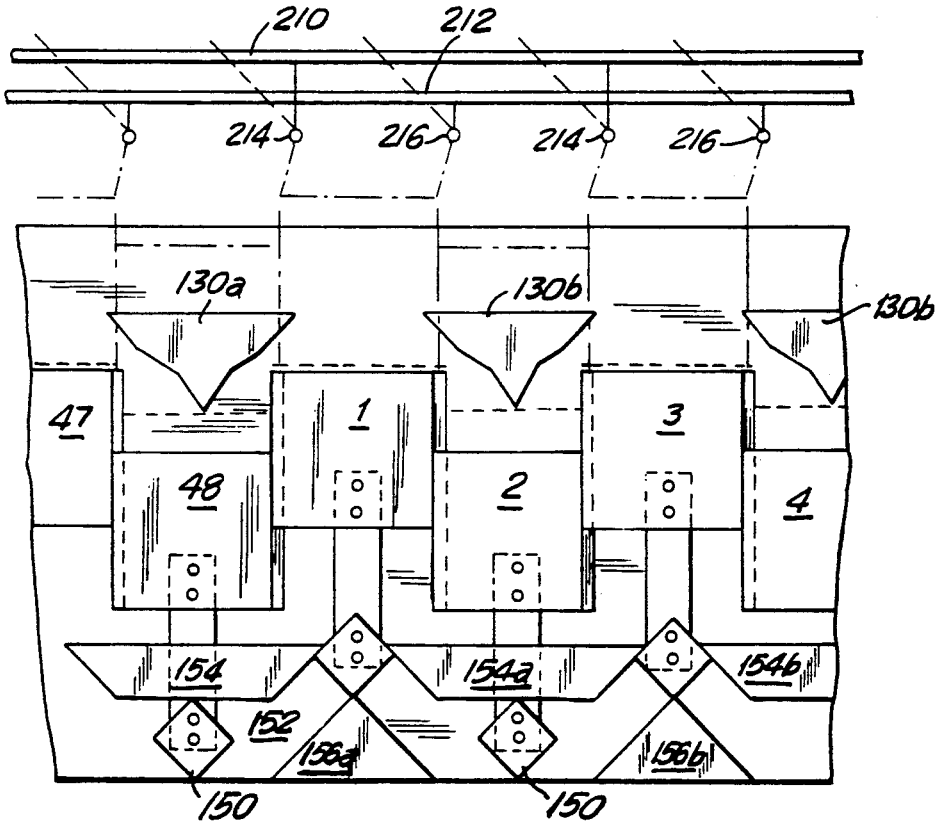
Figure 7A:
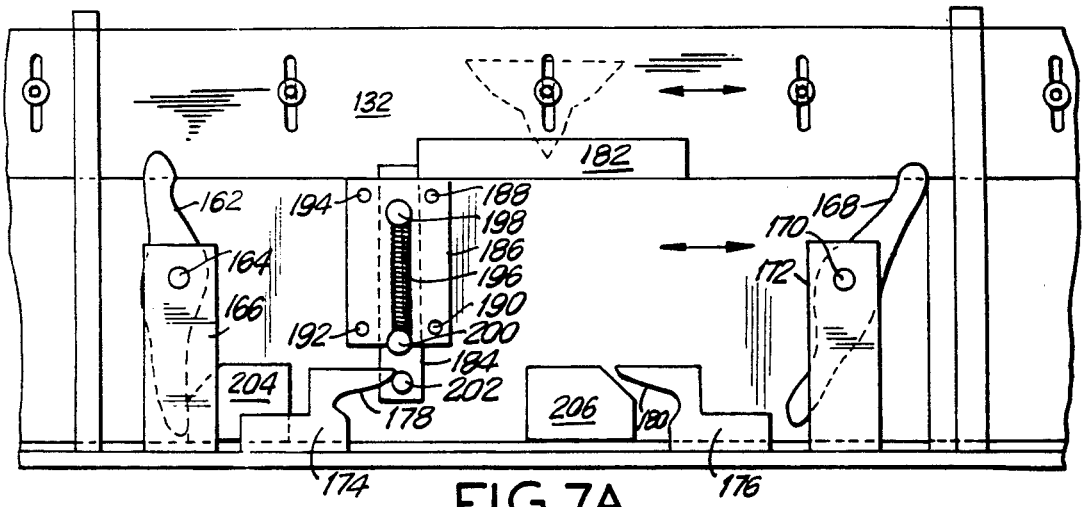
Figure 7B:
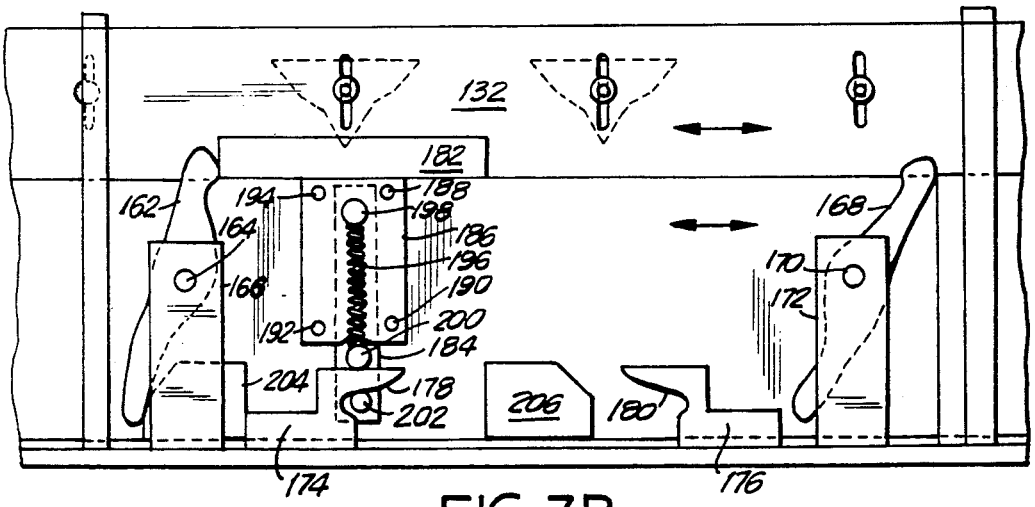
Figure 8A:
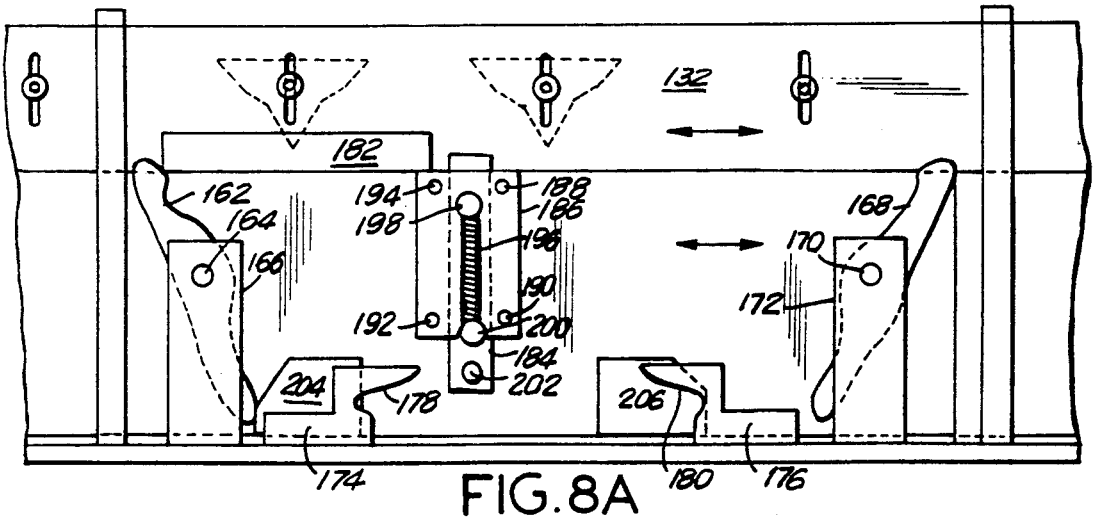
Figure 9:
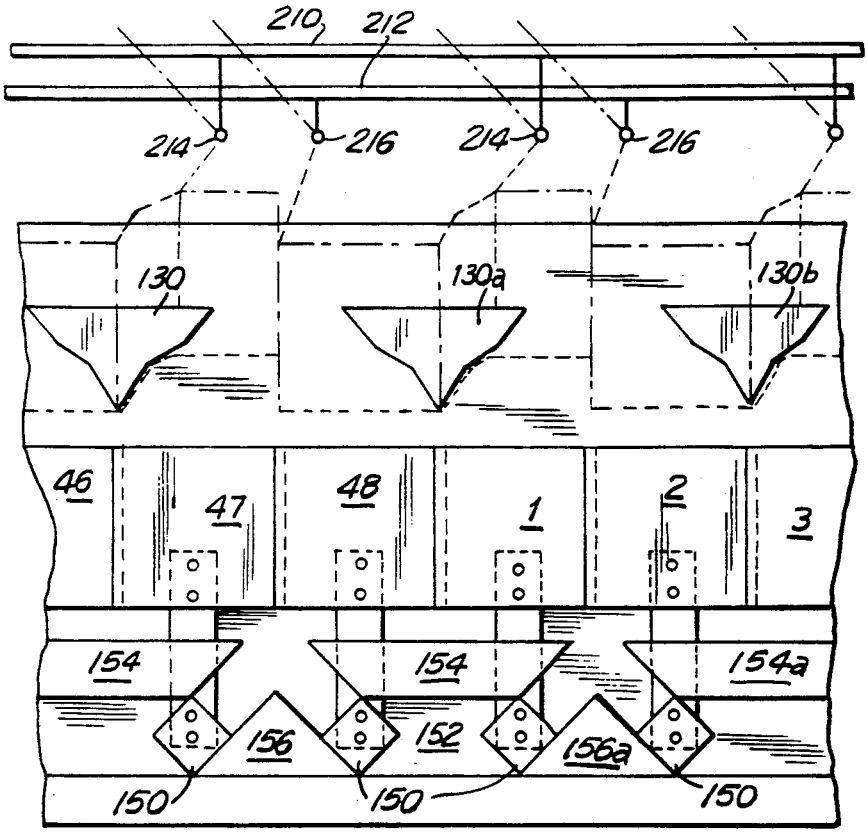
Figure 10:
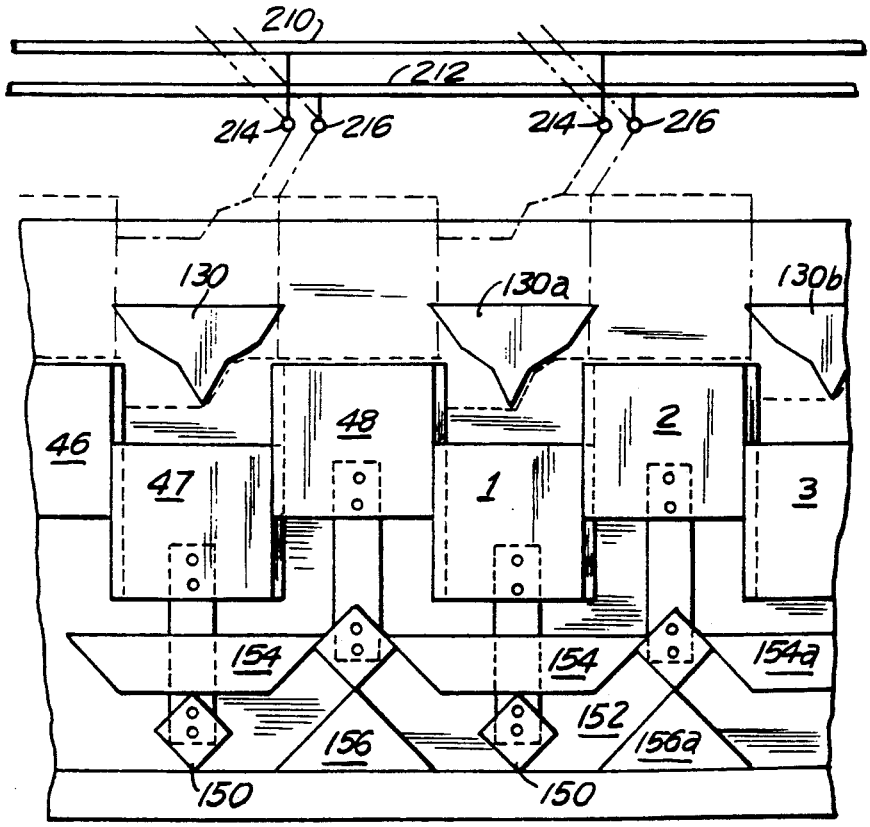
Figure 11:
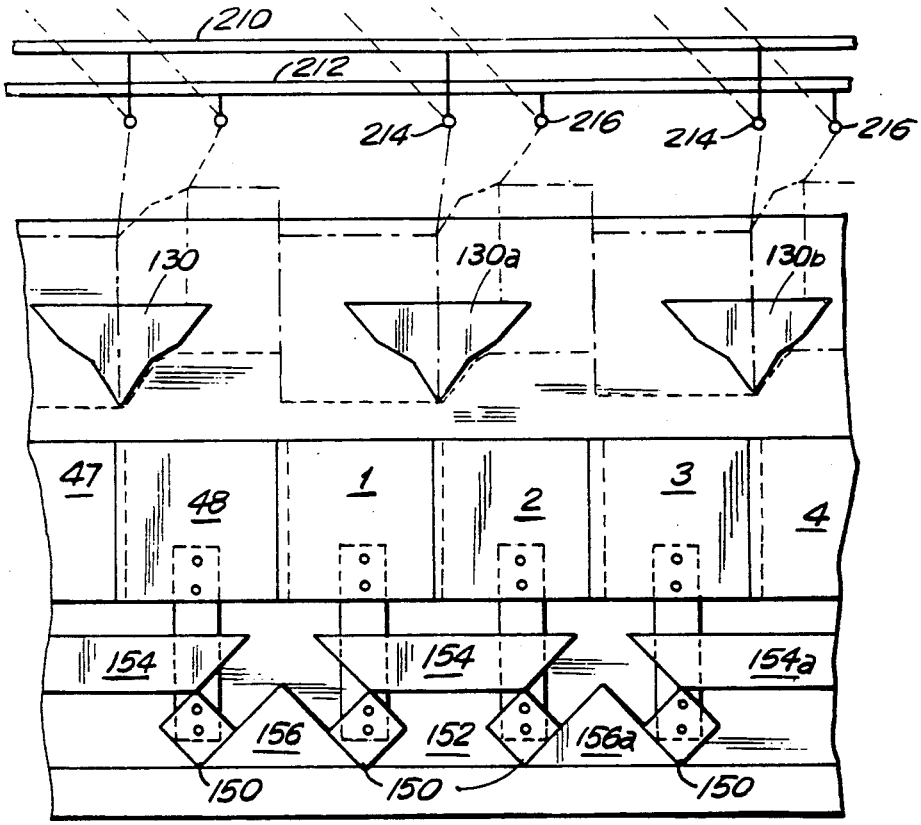
Figure 12:
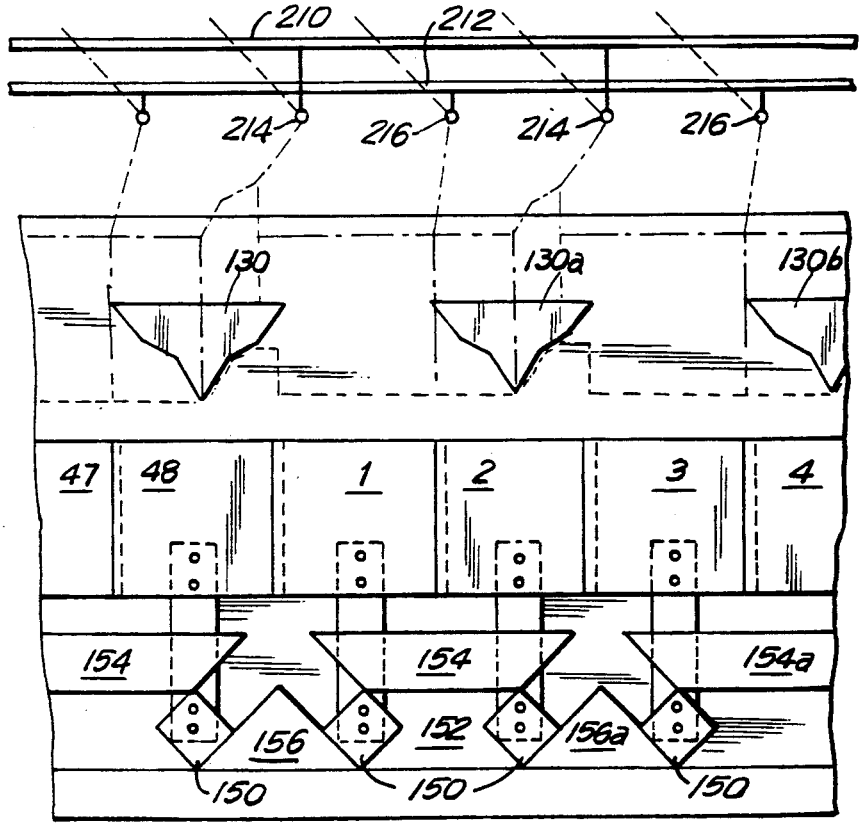
Figure 13:
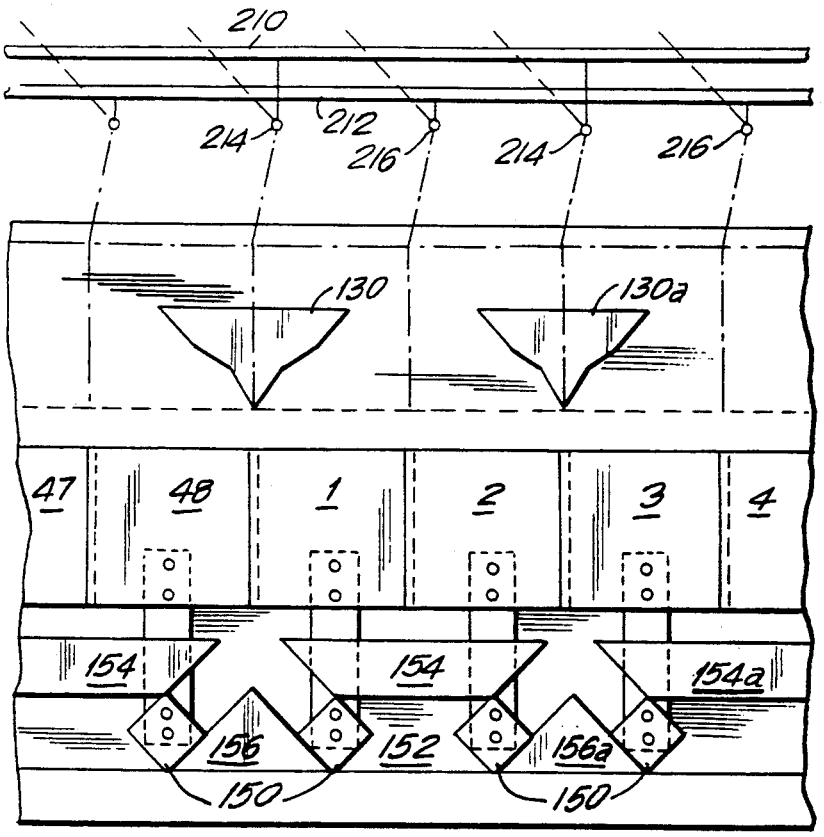
Figure 14:
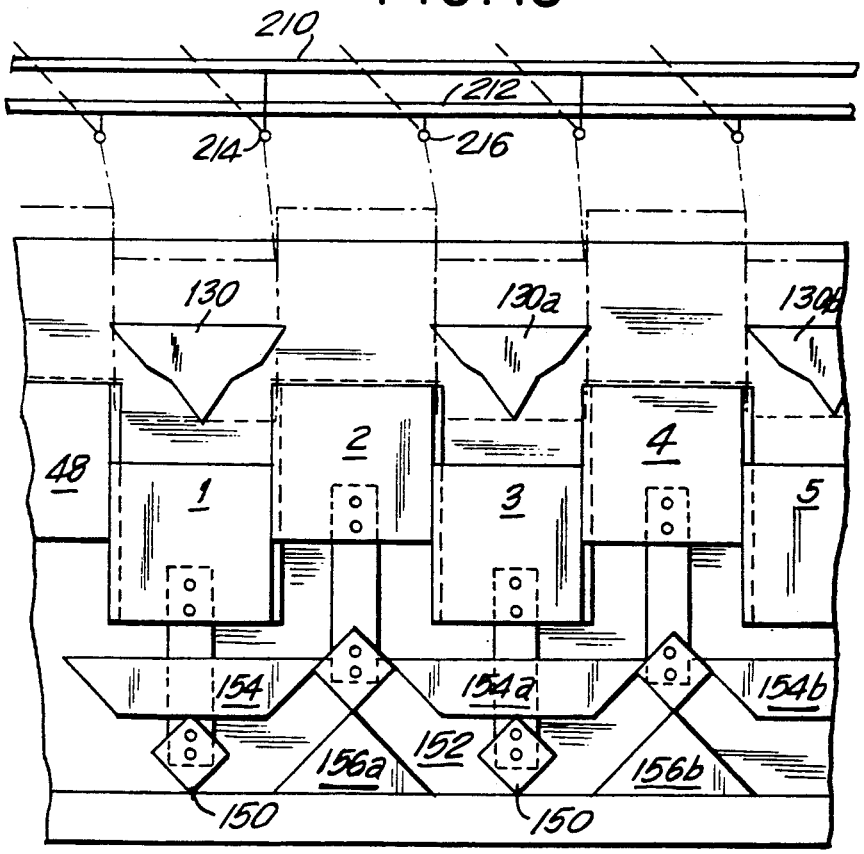
Figure 15:
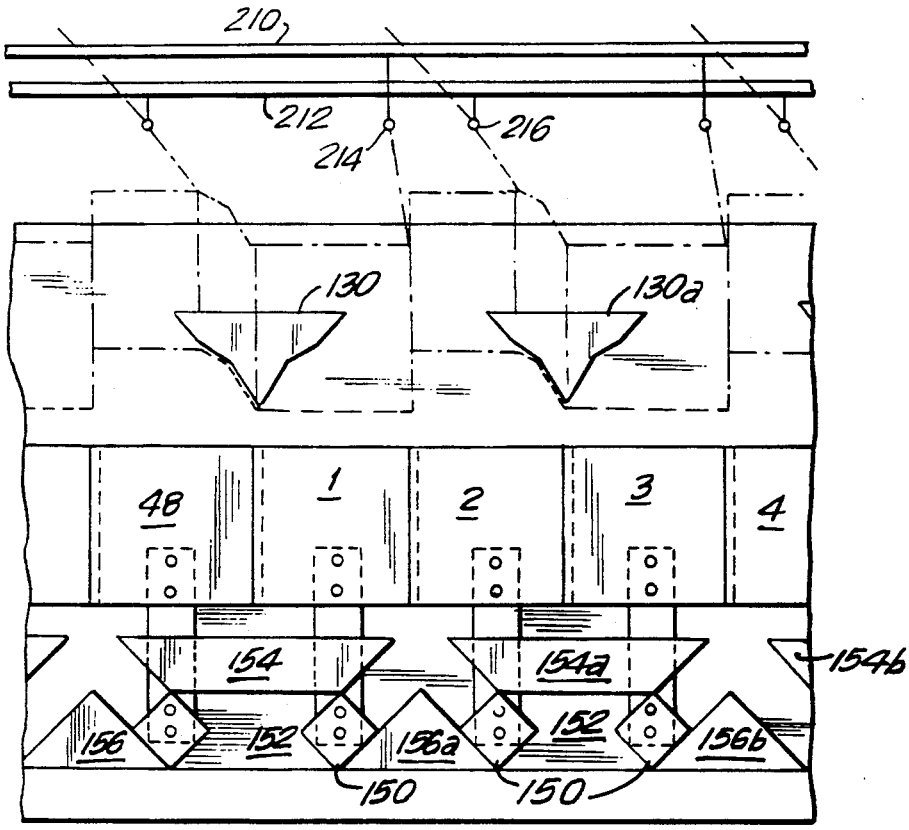
Figure 16:
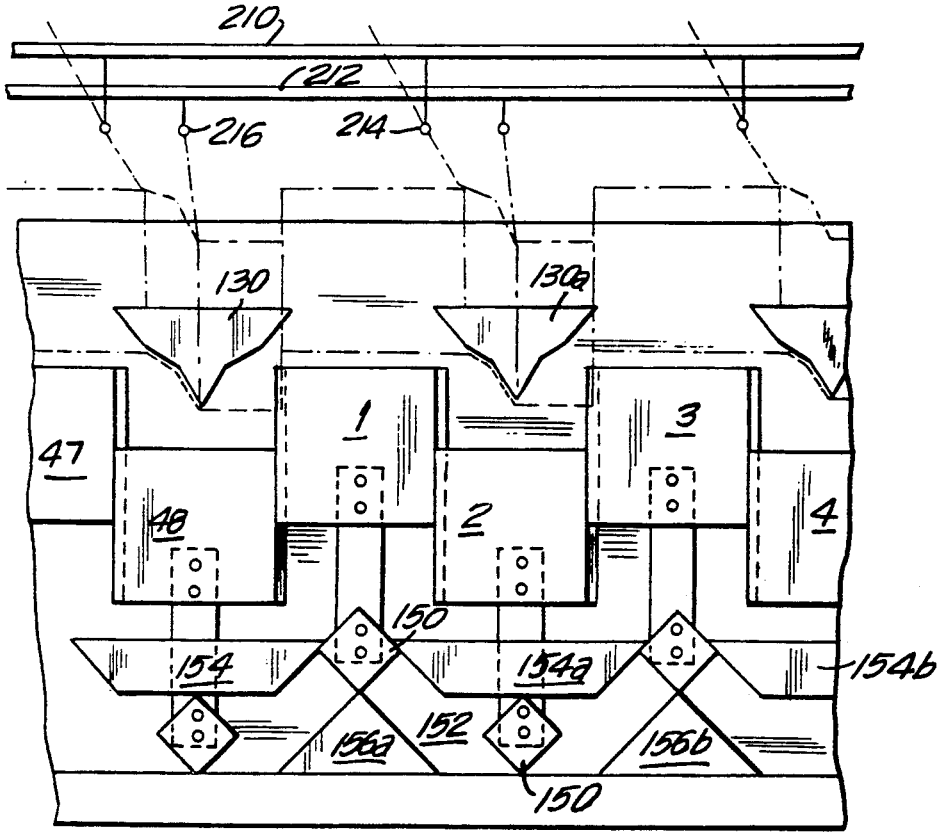
Figure 17:
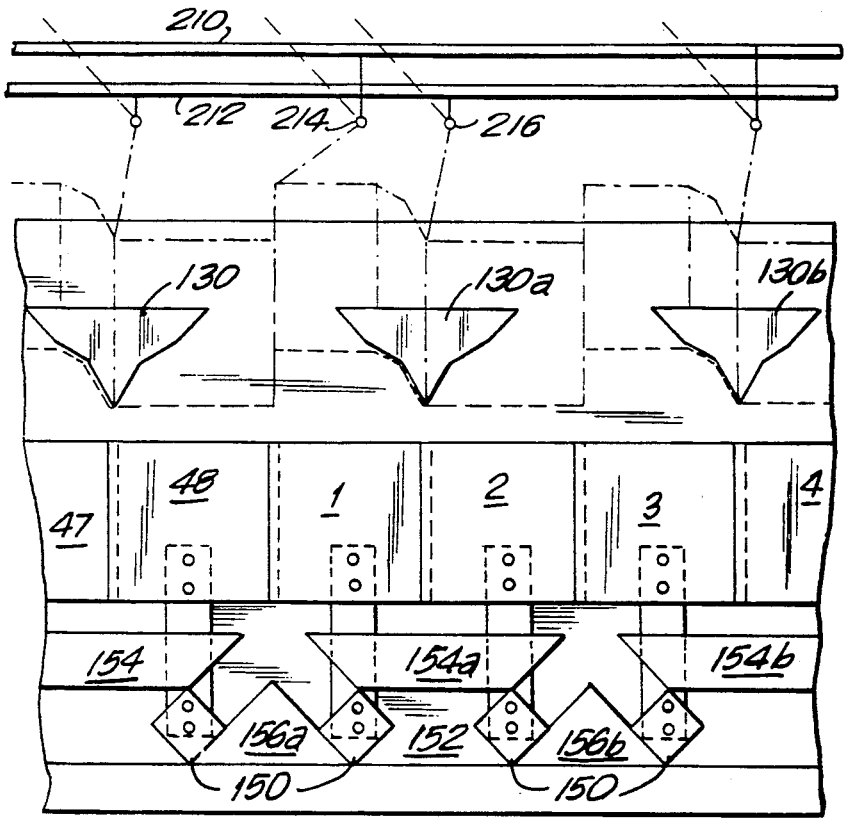
Figure 18:
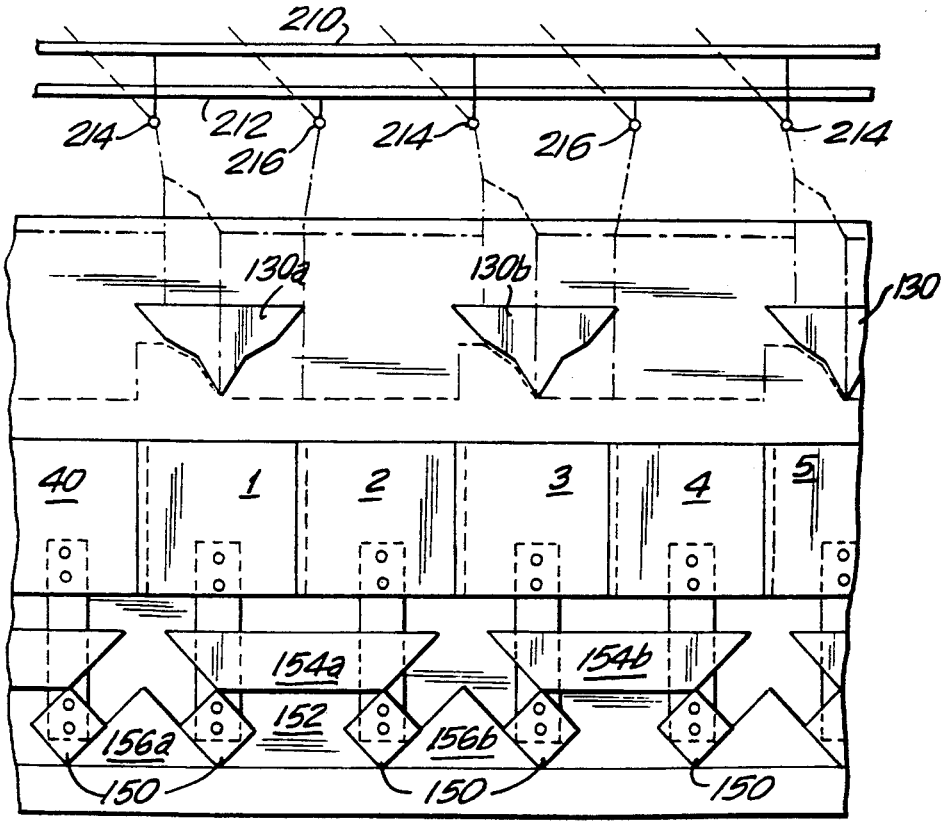
Figure 19:
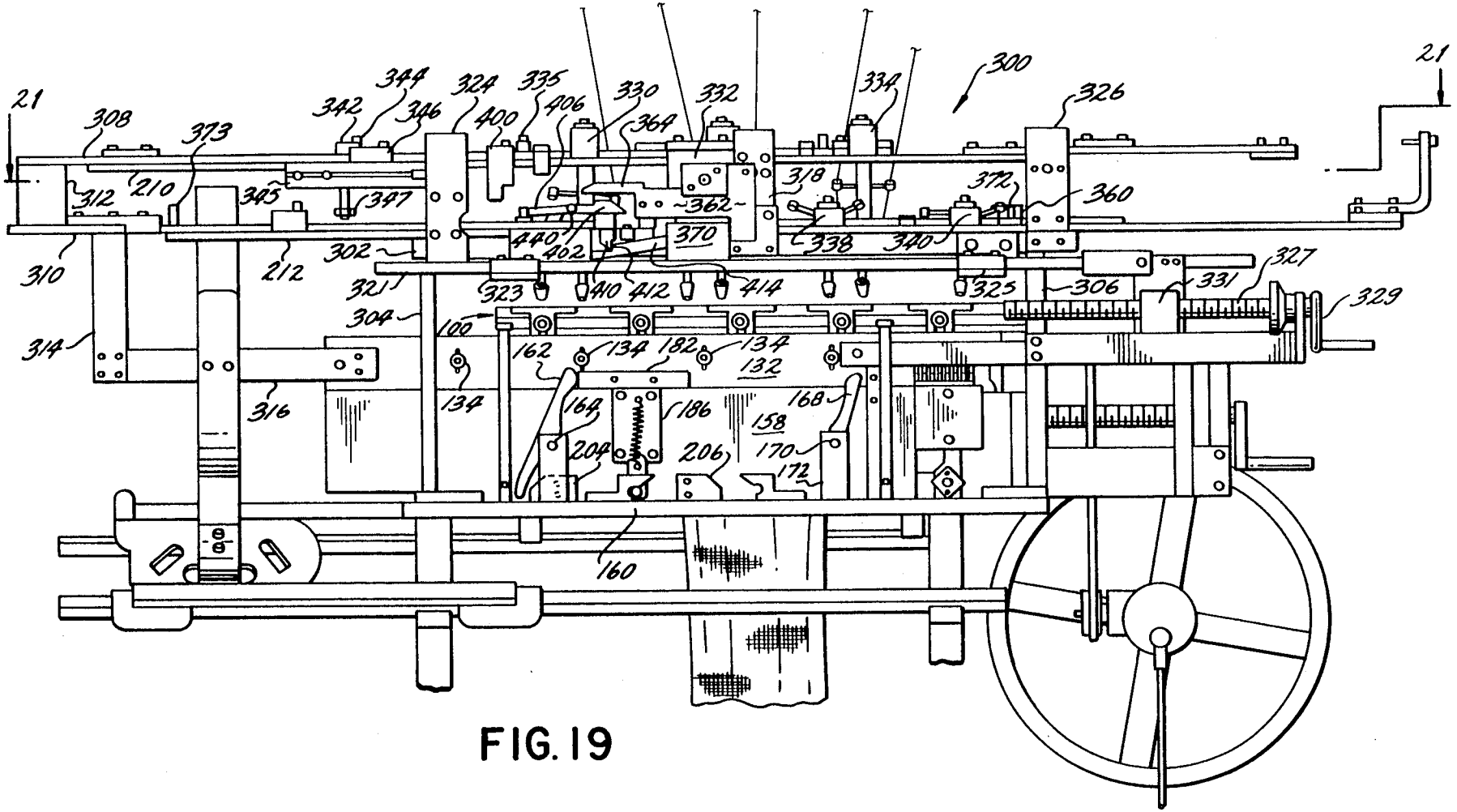
Figure 20:
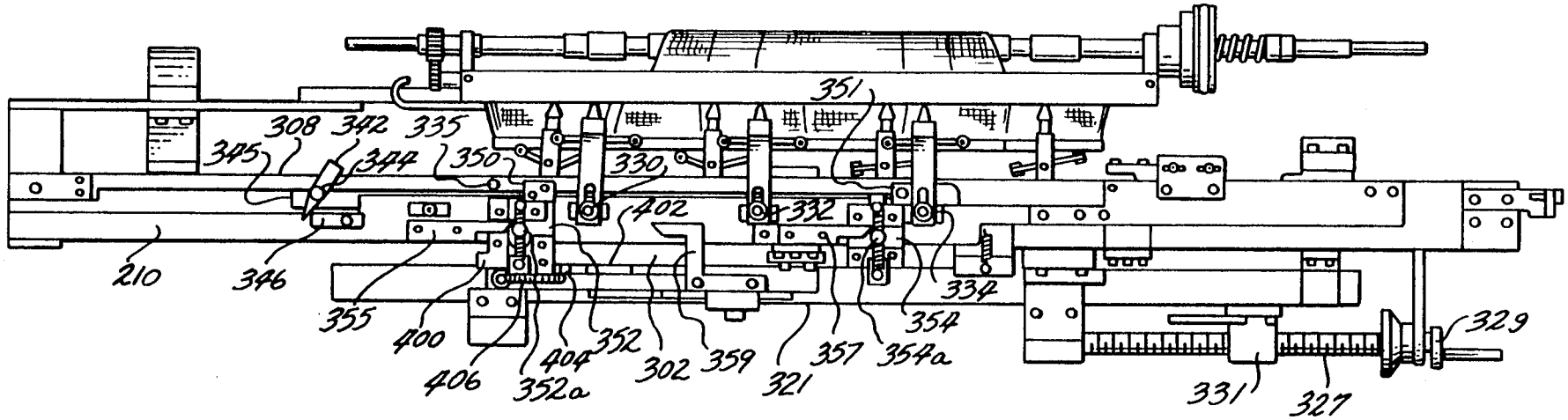
Figure 21:
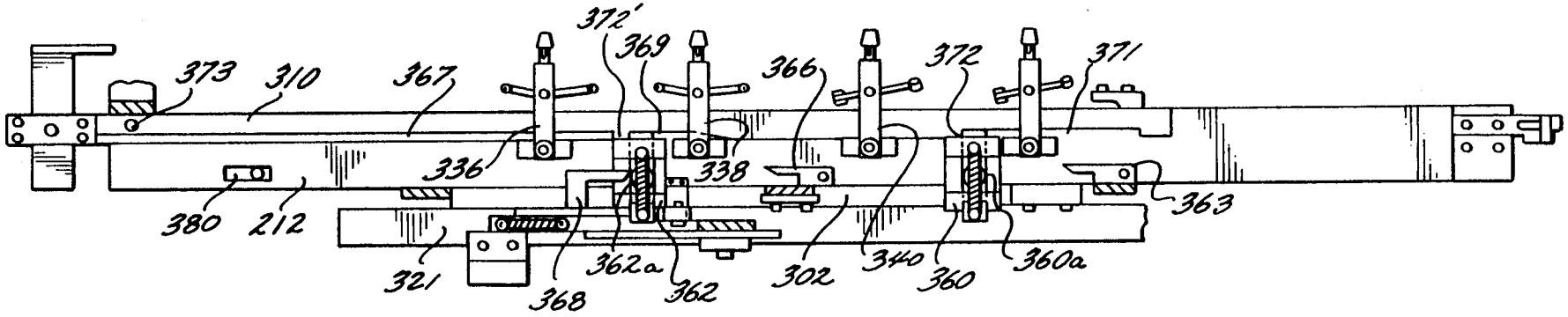
Figure 22:
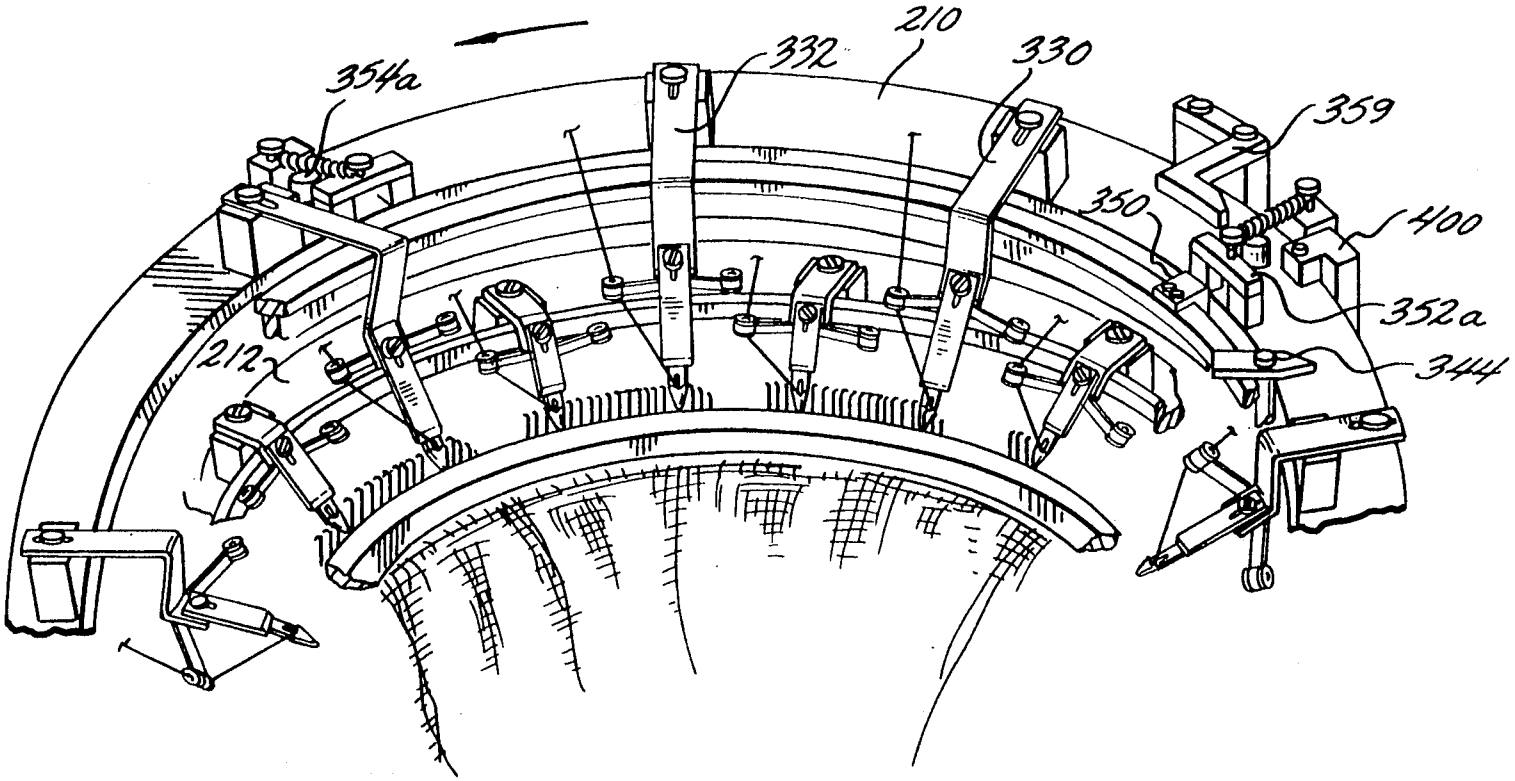
Figure 23:
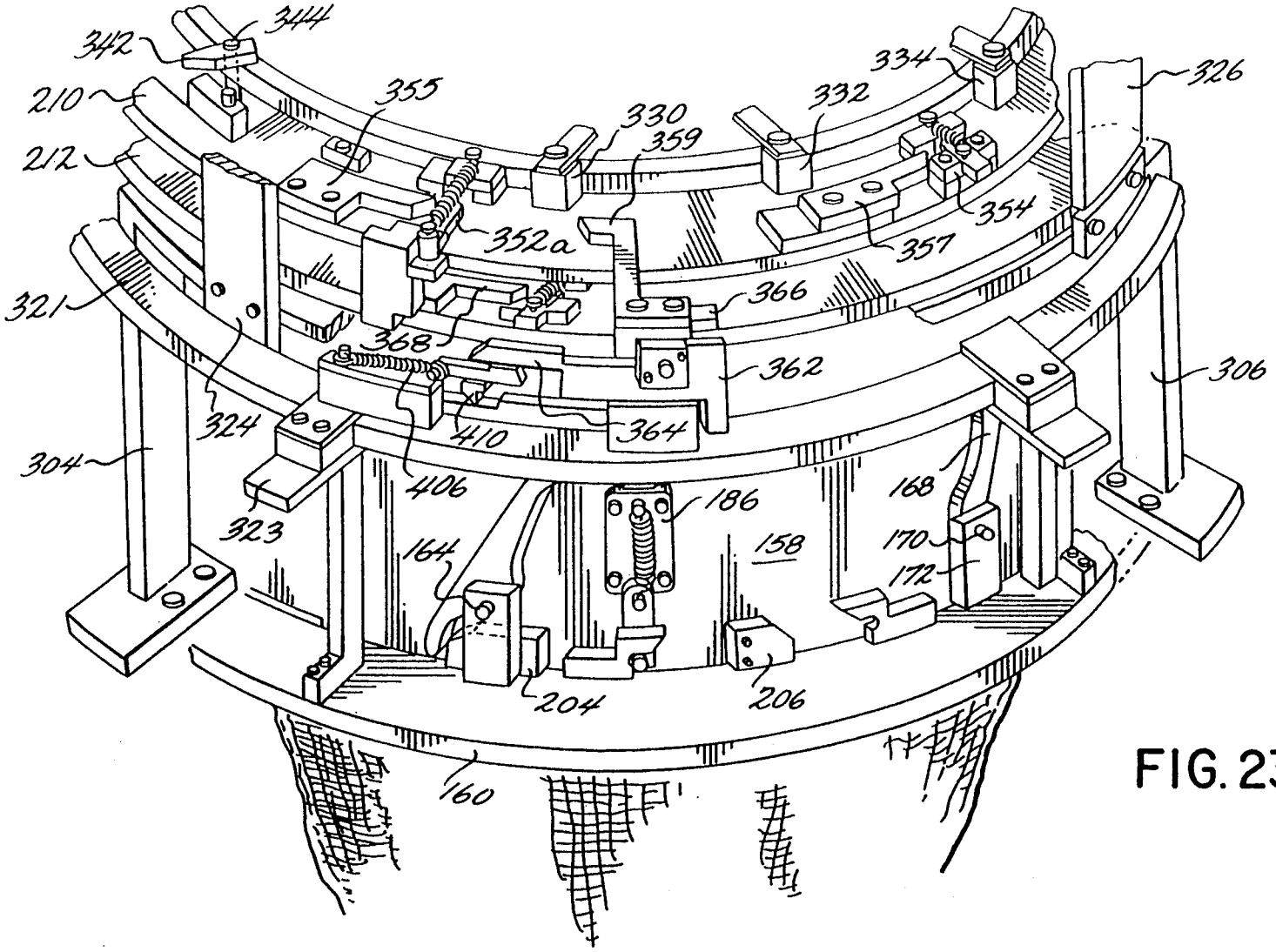

FIGS. 7–18, incl., are enlarged views of the apparatus of FIGS. 1–6, with the covers removed, showing the apparatus at various stages of knitting, with the needles shown diagrammatic;

FIG. 7 shows the apparatus as the knitting cams are moving from right to left, as viewed in the Figure, the knitting for the movement from right to left has been completed and the cams are moving to the left to clear the needle butts;

FIG. 7A is an enlarged view, taken from the outside and looking toward the cylinder with the covers and cam carriers in place and showing the positions of the cam carriers as the cams approach the positions shown in FIG. 7, the latch release pin engages the latch release cam surface, the pusher cam ring latch is released and the pusher cam ring and pushers remain fixed while the knitting cams approach the position shown in FIG. 7;

FIG. 7B is an enlarged view, similar to FIG. 7A but showing the positions of the cam carriers with the cams in the position shown in FIG. 7;

FIG. 8 shows the apparatus as the knitting cams have completed movement to the left, have cleared the needle butts and the needles in the first needle group, to the immediate right of the knitting cam, have been raised;

FIG. 8A is an enlarged view, similar to FIG. 7B but showing the cam carriers with the cams in the position shown in FIG. 8;

FIG. 9 shows the apparatus as the knitting cam has started its movement from left to right, as viewed in the Figure, has partially progressed through the raised needles of the first needle group and is in to process of progressively drawing the needles down to knit as the knitting cam progresses;

FIG. 10 shows the apparatus as the knitting cam, moving from left to right, has progressed to the middle of the first needle group, the needles at the rear of the cam have been drawn down and the raised needles of the first group and in front of the can are progressively being drawn down and the needles of the second group of needles have been raised;

FIG. 11 shows the apparatus as the knitting cam, still moving form left to right, has progressed through the first raised group of needles, has drawn the needles of the first group down to knit and is progressing, to the right, into the second raised group of needles and is drawing the needles of the second group downward to knit, the pusher cams are at their final position to the right and remain in such position until the knitting cams complete knitting to the right;

FIG. 12 shows the apparatus as the knitting cam has progressed still further to the right and to the middle of the second group of needles where the raised needles behind the cam are drawn down and the needles in front of the cam are being progressively drawn down to knit while the pusher cams remain at the final position, as shown in FIG. 11;

FIG. 13 shows the apparatus as the knitting cam has completed the drawing down and knitting of the needles of the second group of needles and the knitting cam is continuing its movement to the right to clear the needle butts;

FIG. 14 show the apparatus as the knitting cam has completed its movement to the right, has cleared the needle butts, the needles of the second needle group have been raised by the movement of the pusher cams to the left as the knitting cams complete their movement to the right, the knitting cam is reversing its movement and will move to the left as viewed in the Figure;

FIG. 15 shows the apparatus as the knitting cam has moved to the left and is progressively drawing the needles of the second group of needles down to knit, the pusher cams have moved to the left and the pushers under the second group of needles has been retracted;

FIG. 16 shows the apparatus of the knitting cams, continuing its movement to the left, has drawn the needles to the rear of the cam down, is progressively drawing the needle in the second group and ahead of the moving cam down and the needles in the first needle group have been raised by the pusher cams moving further to the left;

FIG. 17 shows the apparatus as the needle cam has completed its movement to the left through the second group of raised needles, is moving to the left into the needles of the first raised group and is progressively drawing the needles of the first group down to knit, the pusher cams are at their final position to the left and remain in such final position until the knitting cams complete knitting to the left;

FIG. 18 shows the apparatus as the needle cam has moved left into the middle of the needles of the first raised group, has drawn the needles behind the cam down and is progressively drawing the needles of the first raised group and ahead of the needles down while the pusher cams remain at the final position to the left;

FIG. 19 is an elevation view of the yarn feed positioning apparatus of the instant invention, taken from the cam side of the knitting cylinder, at the knitting position shown in FIG. 1;

FIG. 20 is a top plan view of the yarn feed positioning apparatus of FIG. 19, taken from the top, FIG. 19;

FIG. 21 is a top plan view of the yarn feed positioning apparatus, taken in section from the top at 21—21, FIG. 19;

FIG. 22 is a perspective view of the circular knitting machine taken angularly from the top of the machine shown in FIG. 20 and looking downwardly toward the inside of the machine cylinder; and FIG. 23 is a perspective view, similar to FIG. 22 but taken angularly from the top of the machine shown in FIG. 19 and looking downwardly toward the outside of the machine cylinder.

The method of the instant invention can be carried out on any size circular knit machine suitably adapted, in accordance with the instant invention, for carrying out the method. Depending upon the intarsia design to be knitted, as will be more apparent from the description of the invention which follows, the particular configuration of the machine to carry out the invention can be modified. For purposes of illustration and description, the invention is adapted, in the description which follows, to a circular knit machine having a thirty-three inch diameter needle cylinder which is divided, for invention description purposes, into forty-eight equal size needle groups. Each two contiguous needle groups contain thirty-six needles and make up a knitting section. The invention is readily adapted to other sized cylinders, other needle group divisions and other section arrangements, all as will be more apparent from the description which follows.

Reference now to FIGS. 1A, 1B, 1C and 1D, the essence of the difference between the prior art method and the method of the instant invention are illustrated and will be described. For purposes of clarity, the knitting cams are removed and in FIGS. 1B, 1C and 1D, the needle ends and needle cylinder grooves below the needle butts are omitted.

In the prior art method of knitting jersey fabric with a circular knitting machine, the knitting cams and yarn feeds are held stationary and the needle cylinder is rotated or the needle cylinder is held stationary and the knitting cams and yarn feeds are continuously rotated. In either event, as the knitting cam passes each needle, the needle is first raised, the needle latch is open, the needle hook engages the yarn being fed to the needle by the yarn feed, the needle is drawn down, the needle latch closes and the old stitch loop on the needle is shed and a new stitch loop is held by the needle. As will be obvious to those skilled in the art, from the description which follows, the invention of the instant invention is readily adaptable to either the stationary or rotating needle cylinder circular knitting machine. For purposes of clarity, however, the invention is herein described with respect to a circular knitting machine in which the needle cylinder is stationary and the knitting cams, yarn feed and other elements required for knitting rotate or move transverse the needles.

Figure 1A:
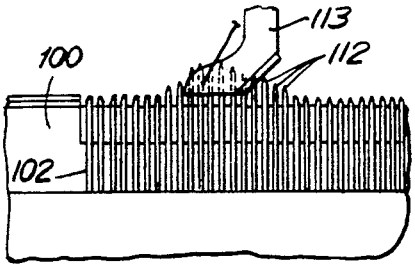
(PRIOR ART) FIG.1A

As best shown in FIG. 1A, in the prior art method practiced with the prior art circular knitting machine with the needle cylinder held stationary, needles 112, in needle grooves 102, of needle cylinder 100 are first raised, or lifted, in sequence one needle after the other, with a conventional knitting cam, not shown, as the cam and yarn feed are rotated around needle cylinder 100. As the needle is lifted, the needle latch is open. The open needle hook engages the yarn being fed to the needles by yarn feed 113. The needle with the engaged yarn are drawn down by the knitting cam through the old stitch loop on the needle to form a new stitch. As the needle is drawn down, the needle latch closes and the needle sheds the old stitch loop into the jersey fabric being knitted. The new stitch is held by the needle. The knitting cam assembly and yarn feed rotate continuously around stationary needle cylinder 100. Depending upon the number of knitting cams and yarn feeds spaced around the cylinder, each rotation of the cam assembly and yarn feed knits one course of stitches at each knitting cam and yarn feed during each rotation. The knit courses pass spirally around the cylindrically knitted tube.

In the method of knitting jersey fabric with a stationary knitting cylinder circular knitting machine in accordance with the instant invention, the needles in the needle grooves of the stationary cylinder are divided into needle groups of equal number of needles by pushers of equal length which extend circumferentially around the cylinder. The knitting cam assembly and the yarn feeds are reciprocated back and forth around the stationary needle cylinder. Each group of needles, as will be described in greater detail later herein, is raised by a pusher. The individual needles in the raised group are drawn down, sequentially one after the other, by a knitting cam. Each needle, as it is drawn down, forms a new stitch loop from the yarn fed to the needle by the yarn feed and sheds the old loop into the jersey fabric being knitted. As the raised needles of the first needle group are being drawn down, one after the other, by the knitting cam, the next following group of needles is raised by the next pusher. The knitting cam, after drawing down and knitting the needles of the first group, draws down, sequentially one after the other, the raised needles of the second group to form, with each needle as it is drawn down, a new stitch loop and to shed the old stitch loop from the needle into the jersey fabric being knitted. After drawing the needles of the second group of needles down, the knitting cam assembly and the yarn feeds are rotated past the second needle group so that the knitting cam clears the needle butts of the second group of needles, the needles of the second group of needles are again raised by the pusher, the pusher is retracted, the yarn feed is repositioned and the direction of rotation of the knitting cam assembly and the yarn feeds relative to the stationary needle cylinder is reversed.

Figure 1B:
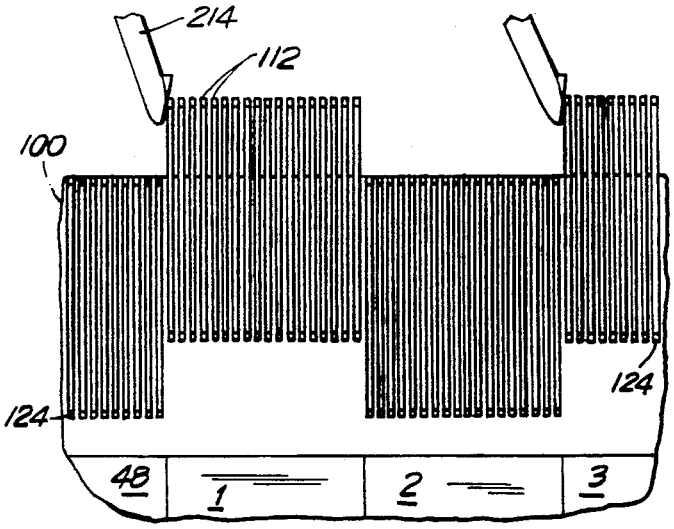
Figure 1C:
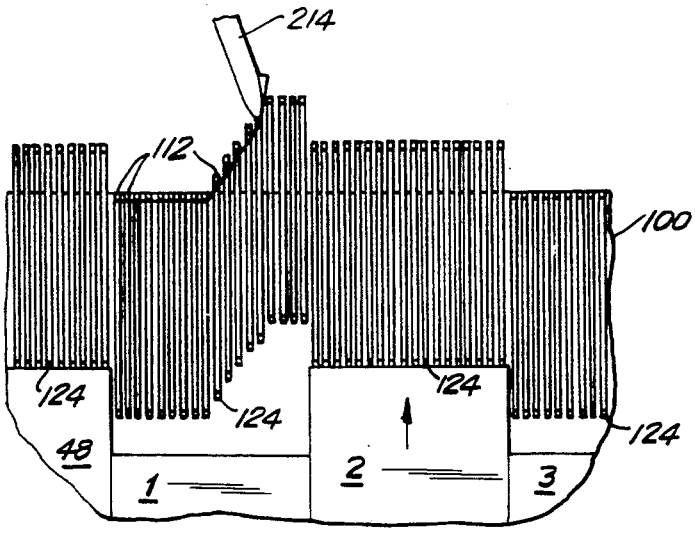
Figure 1D:
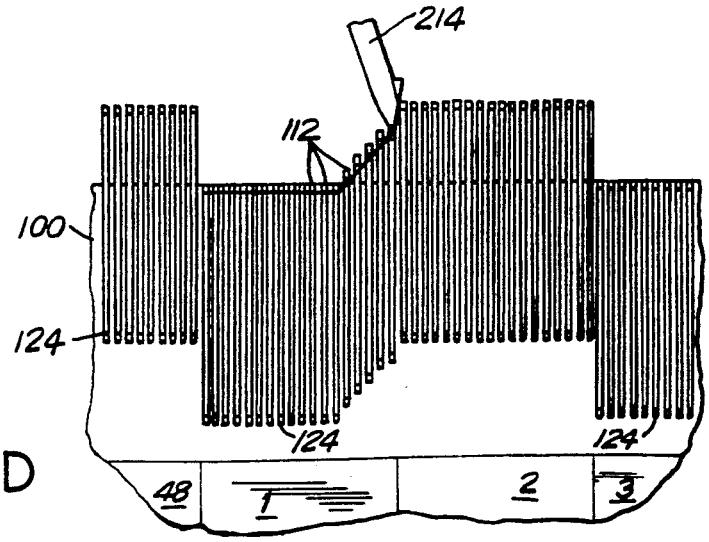

Referring to FIGS. 1B–1D showing the needle action sequence in accordance with the instant invention, in FIG. 1B, the knitting cam assembly and yarn feeds, described in more detail later herein, have completed their travel to the left in FIG. 1B, past needles 112 on needle cylinder 100, the knitting cam, not shown, has cleared butts 124 of needles 112 of the first group of needles, yarn feed 214 has been repositioned, the needles of the first needle group have been raised by pusher 1 and needle butts 124, pusher 1 has been retracted and the knitting cam and yarn feed 214 have commenced moving toward the right, as shown in FIG. 1B.

As best shown in FIG. 1C, as the knitting cam assembly and yarn feed 214 continue their movement from left to right, needles 112 of the first group of needles are drawn down, sequentially one after the other, the hook of each needle, as it is being drawn down, engaging the yarn being fed to the needles by yarn feed 214 and, with the yarn, forming a new stitch loop on the needle. As the knitting cam draws needles 112 of the first group of needles down, pusher 2 commences to move up, engages needle butts 124 and raise the needles of the second needle group.

As best shown in FIG. 1D, as the knitting cam assembly and yarn feed 214 continue their movement still further from left to right, all of needles 112 of the first needle group are drawn down, all of the needles 112 of the second group of needles are pushed up by pusher 2, pusher 2 is retracted to clear the knitting cam and the knitting cam assembly and yarn feed 214 are cleared to move further to the right to draw needles 112 of the second needle group, sequentially one needle after the other, down and form a new stitch loop on each such needle as it is drawn down. As will be more fully described later herein, the knitting assembly and yarn feed 214 move past needles 112 of the second needle group, the knitting cam clears butts 124 of the needles of the second group of needles, yarn feed 214 is repositioned, the needles of the second group of needles are again raised by pusher 2 and butts 124 and, as pusher 2 is retracted, the knitting cam assembly and yarn feed 214 are reversed to move from right to left, as viewed in FIGS. 1B–1D.

Figure 2:
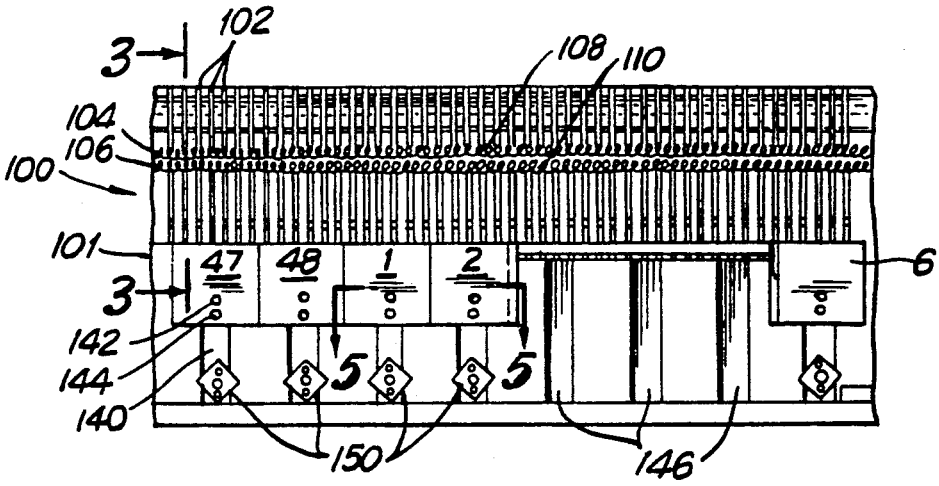
FIG. 2 is a front view of the apparatus of the instant invention, similar to FIG. 1, but showing the yarn carrier, knitting cam assembly and pusher assembly cover removed.

Referring now to FIGS. 1 and 2, the apparatus of the instant invention includes a needle cylinder generally designated 100, mounted on base 101 and having a plurality of needle grooves 102, spaced equidistant of each other and parallel to the axis of and around the periphery of cylinder 100, in conventional manner. Coil springs 104, 106, extend circumferentially around cylinder 100, in grooves 108, 110, in cylinder 100, for purposes hereinafter described.

Figures 3, 3A:
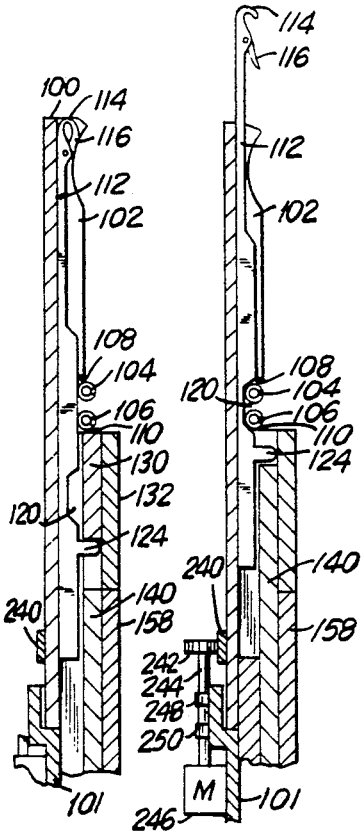
FIG. 3 is an enlarged sectional view taken at 3—3, FIG. 2 and showing a needle as it would appear in the lowered position in the needle groove after being drawn down by the knitting cam.
FIG. 3A is a view similar to FIG. 3 but showing the needle as it would appear in the raised position in the needle groove after being raised by the needle group pusher and showing one embodiment of a mechanism for indexing the needle cylinder.
Figure 4:
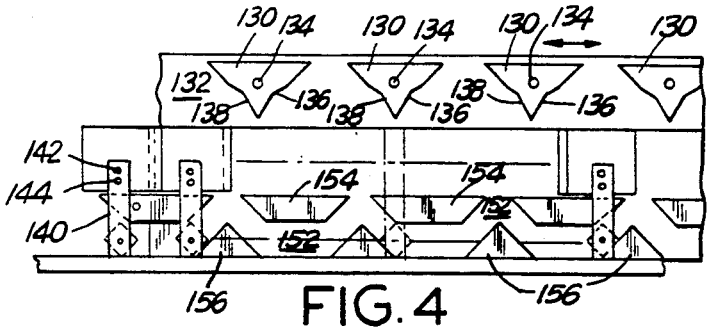
FIG. 4 is fragmentary elevation of a portion of the knitting cams, pushers and pusher cam mechanism of the apparatus of FIGS. 1 and 2, as viewed from within the cylinder and looking outwardly.

Each of the needle grooves 102, on cylinder 100, is provided with a needle, generally designated 112, FIGS. 3 and 3A. At its upper end, in conventional manner, each of the needles 112, is provided with a hook 114, and a latch 116, latch 116, opening and closing, conventionally, as each needle 112 knits, as will be later described.

Still referring to FIG. 3 and 3A, each of the needles 112, is provided with a groove 120, which is engaged by coil springs 104, 106, FIG. 3A, when needle 112, is lifted and which is free of springs 104, 106, FIG. 3, when needle 112, is drawn down, all for purposes later described. Below groove 120, each of the needles 112, FIGS. 3 and 3A, is provided with a butt 124, extending outwardly from needle 112, and outwardly beyond the walls of groove 102.

Referring, next, to FIGS. 1, 2, 3, 3A and 4, knitting cams 130, of which there are twenty-four in the embodiment described, are mounted by Allen bolts 134, in fixed position on knitting cam ring 132, and are spaced equidistant on ring 132, circumferentially around needle cylinder 100. Cam ring 132, is mounted around the periphery of needle cylinder 100, for movement back and forth around the needle cylinder 100, in the directions of the arrow, FIG. 4, for purposes later described. The opposite cam surfaces 136, 138, of cams 130, are identical.

Figure 5:
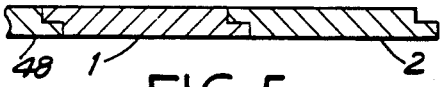
FIG. 5 is a sectional view of the pushers taken at 5—5, FIG. 2.

In the embodiment illustrated and described and for reasons which will be more apparent later herein, there are twenty-four knitting cams 130 mounted on cam ring 132 and equally spaced around needle cylinder 100. Needles 112, around needle cylinder 100 are divided into forty-eight equal number groups of contiguous needles by pushers, designated 1–48, for purposes of description. Each needle group contains eighteen needles which are simultaneously raised, as will be described, by one of the pushers and drawn down, one needle after the other, by knitting cams 130. Two pushers with thirty-six needles are positioned between each pair of cams 130. In the fragment of the apparatus illustrated, pushers 1, 2, 3, 4, 5, 47, 48 appear, it being understood that the balance of the pushers, not illustrated, extend circumferentially around needle cylinder 100. The abutting edges of pushers 1–48 may be overlapped, as shown in the embodiment of FIG. 5 or, as will be later explained, the abutting edges may be flush.

Each of the pushers, 1–48, is mounted on a pusher guide 140, such as by Allen screws 142, 144, FIGS. 2, 4 and 7–18, each pusher guide 140, being mounted in a slot 146, FIG. 2, in base 101, of needle cylinder 100. At its lower end, each of the pusher guides 140 is provided with a cam follower 150. Cam follower 150, for purposes more apparent later herein, travel in cam track 152, FIGS. 4 and 7–18, formed between upper pusher cam follower guide 154 and lower pusher cam follower guide 156. Cam follower guides 154, 156 are fixed, each as by Allen screws, to pusher cam ring 158, FIGS. 1, 3, and 3A, which pusher cam ring extends around needle cylinder 100, and cylinder base 101 and is mounted thereon for reciprocal movement in the direction of the arrows, FIGS. 4, 7A, 76B, and 8A, for reasons later described.

Referring, now to FIGS. 1, 7A, 7B and 8A, support 160 is mounted in fixed position on needle cylinder base 101. Lever 162 is pivotally mounted by pin 164 on lever support 166 fixed to base 160. Lever 168 is pivotally mounted by pin 170 on lever support 172 fixed to base 160. Latch releases 174, 176, having cam surfaces 178, 180, respectively, are mounted in fixed positions on support 160, intermediate lever supports 166, 172, with cam surfaces 178, 180 facing each other for reasons later explained. Knitting cam ring stop 182 is mounted in fixed position on knitting cam ring 132. Pusher cam ring latch 184 is mounted for sliding movement in latch housing 186 fixed, as by screws 188, 190, 192 and 194, to pusher cam ring 158. Latch 184, is biased upwardly in housing 186, by spring 196, fastened at one of its ends by pin 198 fixed to latch housing 186 and, at its other end, to pin 200 fixed to latch 184. Pin 200 act as a stop with latch housing 186 to limit outward travel of latch 184 in housing 186. Latch release pin 202 is mounted in the lower end of latch 184 for engagement with cam surfaces 178, 180, of latch releases 174, 176, for purposes later described. Pusher cam stops 204, 206, are fixed to pusher cam ring 158 for contact with the end of levers 162, 168, respectively.

As best shown in FIGS. 1, 4 and 7–18, the apparatus of the instant invention includes two yarn carriers, designated 210, 212. Depending upon the design being knitted, one carrier might be used for the knitting or knitting might be divided by knitting first from the yarn fed from the yarn fed from one carrier and then the yarn fed from the other carrier.

As will be more fully described with reference to the yarn feed apparatus in FIGS. 19–21, described later herein, as knitting cams 130 reciprocated past contiguous needle groups to knit the needles in such groups, the yarn feeds and the yarn being fed thereby are advanced with the knitting cams 130 to position the yarn being fed so as to engage the respective knitting needles. As the cams 130 are rotated further, one-halt the length of the next contiguous needles, without knitting, the yarn feeds and the yarn being fed thereby are repositioned so as to engage the respective knitting needles when knitting is commenced in the reverse direction.

In the operation of the instant circular knitting machine to practice the invention of the method, knitting cam ring 132 is reciprocated or oscillated, back and forth, around needle cylinder 100 a fixed distance, such as by continuously rotating wheel 103 and arm 105 attached at one end, by pin 107, to wheel 103 and, at its opposite end, by pin 109, to cam ring 132, shown diagrammatically in FIG. 1, while needle cylinder 100 remains stationary. Needle 112, in contiguous needle groups are lifted in groups relative to the oscillating rotation of knitting cam ring 132, and knitting cams 130, mounted on cam ring 132, and are drawn down, one needle after the other needle, by knitting cam ring 132, to knit the fabric. Thus, as best shown in FIGS. 1B–1D, in the embodiment of the invention illustrated and described, all eighteen needles 112, representing one needle group, are simultaneously lifted and are then sequentially, one after the other, drawn down to knit as knitting cams 130 are reciprocated with knitting cam ring 132.

Each knitting cam 130, as will be described, is reciprocated in a first direction past two contiguous needle groups to knit the needles in such groups, is rotated, further, one-half the length of the next contiguous group, without knitting, to clear the cam and needles and is then reciprocated in the reverse direction to again knit the needles of the two lifted needle groups, rotated one-half length past the knitted groups, without knitting to again clear the cam and needles and is again reversed, as the knitted cam is rotated further one-half the length of the next contiguous group without knitting, and is reciprocated in the reverse direction. As will be described later herein the yarn carrier 210, 212 from which, at the time knitting cam 130 is reverse, yarn is being fed to the knitting needles, is also reposition to position the yarn being fed for engagement with the needles when the direction of knitting is reversed.

Referring, now, to FIGS. 7, 7A, 8, 8A and 9–18, for purposes of describing the operation of the apparatus and the method of knitting in accordance with the invention, the operation of the apparatus with regard to lifts and 2, cam follower guides designated on the Figures and referred to in the description as 154*a*, 154*b*, 156*a* and 156*b* and the knitting on the group of needles lifted by lifters 1 and 2, FIGS. 7–18, and knitted by cam 130, designated on the Figures and referred to in the description as 130*a*, will be described. The immediately adjacent knitting cam 130, designated in FIG. 7, 7A, 8, 8A and 9–18 as 103*b*, is also referred to in the description which follows for a better understanding of the apparatus and the knitting carried on therewith. It is to be understood that the operation hereinafter described in connection with lifters 1 and 2, the needle groups lifted thereby, cam follower guides 154*a*, 154*b*, 156*a* and 156*b* and knitting cams 130*a* and 130*b* are simultaneously carried out at the other pairs of lifters circumferentially around needle cylinder 100, needles 112, knitting cams 130 and cam follower guides 154, 156 associated therewith. Knitting cam ring 132 and pusher cam ring 158 may be interlinked to carry out the knitting with a single mechanism, as hereinafter described, or a plurality of mechanisms spaced around needle cylinder 100 and acting simultaneously might be employed. Other arrangement might also be employed.

Referring to FIGS. 1, 7, 7A and 7B, needle cylinder 100 is stationary and knitting cam ring 132, with knitting cams 130 mounted thereon and fixed thereto, is reciprocated or oscillated, back and forth, in the direction of the arrows, FIG. 7A, 7B, by wheel 103, arm 105 and pins 107, 109, FIG. 1, or by any known mechanism for providing oscillating motion, as will be described, between designated limits.

As best shown in FIGS. 7A, 16 and 17, as knitting cam ring 132 moves from right to left, as viewed in the Figures, knitting cam ring 132 through knitting cam ring stopper 182, pusher cam ring latch 184 and pusher latch housing 186, moves pusher cam ring 158 to the left, moving cam follower guides 154*a*, 154*b*, 156*a*, 156*b* to the left, FIGS. 17, 17, and drawing pushers 1, 3 and the odd numbered pushers around needle cylinder 100 downward. As knitting cam ring 132 and pusher cam ring 158 continue to move from right to left, latch release pin 202, on latch 184, engages cam surface 178, on latch release 174, latch 184 is released from knitting cam ring stop 182, knitting cam ring 132 continues to move from right to left and pusher cam ring 158 is stopped by latch release 174. Pushers 1 and 2 and the even and the odd numbered pushers around needle cylinder 100 are drawn downward and remain in the downward position while knitting cam ring 132 completes its movement from right to left to the position shown in FIG. 7, as will be explained.

Referring, now, to FIGS. 7, 7B, knitting cam ring 132 is moving from right to left, as viewed in the Figures, pushers 47, 48, 1, 2, 3 and 4 and the needle groups associated with each pushers are down, knitting cam 130*a* is intermediate pushers 48 and 1 and knitting cam 130*b* is intermediate pushers 2 and 3. Latch release pin 202 is in engagement with cam 178 of latch release 174, pusher cam ring latch 184 is retracted in latch housing 186, knitting cam ring stop 182 is in contact with the upper end of lever 162 and pusher cam ring stop 204 is in contact with the lower end of lever 162. As knitting cam ring 132, with knitting cams 130 and knitting cam ring stop 182 affixed thereto continues its movement from right to left, knitting cam ring stop 182, in engagement with the upper end of lever 162, pivots lever 162, in a counter-clockwise direction, around pin 164 causing the lower end of lever 162, in engagement with pusher cam ring stop 204, fixed to pusher cam ring 158, to push pusher cam ring stop 204 and pusher cam ring 158 an equal distance toward the right. As lever 162 is rotated, counter-clockwise, around pin 164 and pusher ring stop 204 and pusher cam ring 158 are advanced to the right, cam follower guides 154, 154*a*, 154*b*, 156*a*, 156*b*, FIGS. 7 and 8, are moved toward the right, cam follower 150 of pusher 1 is moved upward in cam track 152 and pusher 1 and needles 112 above pusher 1 are pushed up. Thus, needles 112, above pusher 1, are lifted from the knitted position, with latch 116 closed as shown in FIG. 3, to the lifted position, with latch 116 open and groove 120 in the lifted needles, as shown in FIG. 3A, in engagement with coil springs 104, 106, for purposes later described. As best shown in FIGS. 8, 8A and 9, when knitting cam ring 132 reaches the end of its travel, from right to left, has reversed and commences travel from left to right, pusher 1 is up, cam 150 of pusher 1 is in its uppermost position in cam track 152, needles 112 above pusher 1 are in lifted position, latch release pin 202 has been moved to the right out of cam surface 178 of latch release 174, pusher cam ring latch 184 has been released and the end of latch 184 has been raised by spring 196 and is in contact with the end of knitting cam ring stop 182.

As knitting cam ring 132 moves from the left, FIG. 8A, toward the right, knitting cam ring stop 182, fixed to ring 132 and in contact with the latch 184, mounted on pusher cam ring 158, moves pusher cam ring 158 toward the right. As knitting cam ring 132, with knitting cams 130 affixed thereto and pusher cam ring 158, with cam follower guides 154, 154*a*, 154*b*, 156*a*, 156*b*, FIGS. 7, 8 and 9, affixed thereto, move toward the right, cam follower 150 of pusher 1 in cam track 152 is drawn downward, FIG. 9, leaving needles 112 lifted by pusher 1 in lifted position and held in such lifted position by coil springs 104, 106 in needle groove 120. Knitting cam ring 132, and pusher cam ring 158, continue to advance toward the right, advancing knitting cams 130, 130*a*, 130*b* and pusher cam follower guides 154, 154*a*, 154*b*, 156, 156*a*, 156*b* toward the right. Knitting cam 130*a*, advancing across needles 112, lifted by pusher 1, draws the needles, one after the other, down, form the position of FIG. 3A to the position of FIG. 3, while at the same time, cam follower guides 154*a*, 156*a*, FIGS. 9 and 10, mounted on and affixed to pusher cam ring 158, lift cam follower 150 of pusher 2 to, in turn, lift needles 112 above pusher 2.

As knitting cam ring 132 and pusher cam ring 158 continue to advance toward the right, FIGS. 10 and 11, knitting cam 130*a* draws needles 112, lifted by pushers 1 and 2, down to knit while, at the same time, cam follower guides 154*a*, 156*a*, fixed to pusher cam ring 158, draws cam followers 150 of pusher 2 in cam track 152 down, leaving needles 112 above pusher 2 in the lifted position until drawn down by knitting cam 130*a*. As pusher cam ring 150, approaches the position where, as shown in FIG. 11, pusher 2 has lifted needles 112 grouped therewith and pusher 2 has been drawn down in cam track 152 by cam follower guides 154, 156*a*, latch release pin 202, FIGS. 7A, 7B, 8A, contacts cam surface 180 of latch release 176, latch 184 is drawn down in latch housing 186 and, when cam follower 150 of pusher 2 reaches the position in cam track 152 shown in FIG. 11, latch 184 and knitting ring stop 182 are released. The leading end of cam ring stop 206 is in contact with the bottom end of lever 168 and has rotated lever 168 counter clockwise around pin 170. The upper end of lever 168 is still spaced from the leading end of knitting cam ring stop 182.

While knitting cam ring 132, with knitting cams 130, 130*a*, 130*b*, FIGS. 11 and 12, attached thereto continues to move from left to right to complete the knitting by knitting cam 130*a* of needles 112 lifted by pusher 2, pusher cam ring 158 and cam follower guides 154, 154*a*, 156, 156*a*, remain stationary. However, when knitting cams 130, 130*a* reach the position shown in FIG. 13, knitting cam ring stop 180, on knitting cam ring 132, FIGS. 7A, 7B, 8A, contacts the upper end of the lever 168 and, as knitting cam ring 132 continues to move toward the right, pivots lever 168, clockwise around pin 170 causing the lower end of lever 168, in contact with pusher cam stop 206, fixed to pusher cam ring 158, to move stop 206 and pusher cam ring 158 toward the left. Such leftward movement to pusher ring 158, moves cam follower guides 154, 154*a*, 156, 156*a*, FIGS. 13, 14, fixed to ring 158, to the left, lifting cam follower 150, attached to pusher 2, in cam track 152 and lifting needles 112 above pusher 2 into the elevated position as shown in FIG. 14.

When knitting cam 130*a* and knitting cam ring 132, to which, as already noted, knitting cam 130*a* is attached, reaches the position shown in FIG. 14 and cam follower guides 154*a*, 156*a*, along with follower guides 154, 154*b*, 156, 156*b*, FIG. 14, have been moved to the right to lift pusher 2, pusher cam ring 158 has also been moved to the left, releasing latch pin 202, of pusher cam ring latch 184, from cam surface 180, and latch release 176. The upper end of latch 184, when pin 202 is released, is raised by spring 196 to engage the left hand leading end of knitting cam ring stop 182. Thus, as knitting cam 130*a* reaches the position shown in FIG. 14, and knitting cam ring 132 stops, reverses movement and commences to move from right to left, knitting cam ring 132 and pusher cam ring 158 are again reconnected by stop 182, and latch 184, for movement together toward the left.

As knitting cam ring 132 moves to the left, FIGS. 14 and 15, knitting cam 130*a* draws needles 112 lifted by pusher 2 and held in lifted position by springs 104, 106, in needle grooves 120 from the lifted position shown in FIGS. 3A to the knitting position shown in FIG. 3. At the same time, knitting cam ring 132, through latch 184 and knitting cam ring stop 182, moves pusher cam ring 158 and cam follower guides 154, 154*a*, 154*b*, 156, 156*a*, 156*b*, attached thereto, FIGS. 14 and 15, to the left, drawing cam follower 150 of pusher 2 downward in cam track 152 and drawing pusher 2 down, FIG. 15. As knitting cam ring 132, knitting cams 130, pusher cam ring 158, and cam follower guides 154, 154*a*, 154*b*, 156, 156*a*, 156*b*, continue to move to the left, needles 112, lifted by pusher 2 continue to be drawn down, one after the other, by knitting cam 130*a*. Cam follower 150 of pusher 1 is lifted in cam track 152, between cam follower guides 154*a*, 156*a*, FIG. 16. Needles 112 in the group of needles above pusher 1, FIG. 16, are lifted and held in lifted position by springs 104, 106 in needle grooves 120 until drawn down by the knitting cam.

From the position shown in FIG. 16, knitting cam ring 132, knitting cams 130 attached thereto, pusher cam ring 158 and cam follower guides 154, 154*a*, 154*b*, 156, 156*a*, 156*b*, attached to the pusher cam guide continue to move to the left. As best shown in FIG. 17, cam follower 150 of pusher 1 is drawn down in cam track 152, leaving needles 112 lifted thereby in lifted position until drawn down by knitting cam 130*a*. As knitting cam ring 132 and pusher cam ring 158 approach the position shown in FIG. 17, latch release pin 202 comes into contact with cam surface 178 of latch release 174, FIGS. 7A, 7B, 8A, pin 202 and pusher cam ring latch 184 are cammed downward and latch 184 and knitting cam ring stop 182 are released. Pusher cam ring stop 204, FIG. 7A, is in contact with the lower end of lever 162.

With pusher cam ring latch 184 and knitting cam ring stop 182 released, knitting cam ring 132 continues to move to the left and pusher cam ring 158 remains stationary. As knitting cam ring 132 continues to move to the left, FIG. 18, knitting cam 130*a* draws needles 112, lifted by pusher 1, down into knitted position until all of the needles are drawn down, the leading end of the knitting ring stop 183, FIG. 7B, contacts the upper end of lever 162 and knitting cam ring 132, pusher cam ring 158, pushers 1 and 2, cams 130*a*, 130*b*, cam follower guides 154, 154*a*, 154*b*, 156*a*, 156*b* and needles 112 are in the position shown in FIG. 7 and described in reference thereto. The cycle is repeated, one row of stitches being knitted on each cycle from left to right and on each cycle from right to left.

Because, in the embodiment described, there are forty-eight needle groups around the cylinder with twenty-four knitting cams, one for each two needle groups, in each cycle from left to right and each cycle from right to left each knitting row of course will have twenty-four sections.

Referring, now, to FIGS. 19–21, yarn feed apparatus, generally designated 300, FIG. 19, is mounted above needle cylinder 100 on fixed base 302 mounted in fixed position above needle cylinder 100 on supports 304, 306 fixed to machine base 160. Needle cam slide members 308, 310, interconnected at one end by spacer 312 and slidable, at their other end on block 318, mounted on fixed base 302, are attached, by arm 314, 316, to cam ring 132 for reciprocating movement with respect to machine base 160 and fixed base 302, as cam ring 132 is reciprocated, or oscillated back and forth, as hereinabove described.

Upper yarn carrier 210, FIGS. 19 and 20, and lower yarn carrier 212, FIGS. 19 and 21, are mounted for reciprocating movement with respect to machine base 160 and needle cam slide members 308, 310, as will be described, on fixed supports 324, 326, fixed to fixed base 302. Upper yarn feeds 330, 332, 334 are mounted in fixed position, on upper yarn carrier 210, FIGS. 19 and 20. Lower yarn feeds 336, 338, 340 are mounted, in fixed position, on lower yarn carrier 212, FIGS. 19 and 21.

Adjustable support 321 is slidably mounted in brackets 323 and 325, FIG. 19, mounted on fixed base 302 and is adjustable in brackets 323 and 325, relative to fixed base 302, slide needle cam members 308, 310, and upper yarn carrier 210 and lower yarn carrier 212, by feed screw 327 and handle 329 mounted in block 331 on machine base 160 and connected to adjustable support 321 by connector plate 333, FIG. 20, for purposes more apparent in the description which follows.

Pin 335, FIGS. 19 and 20, is mounted on upper needle cam slide 308. Lever 342, FIGS. 19 and 20, is pivotally mounted on pin 344 fixed to plate 345, in turn, fixed to support 304. A second lever 347, FIG. 19, is pivotally mounted on the lower end of pin 344. Pin **362*a*, FIG. 21, is fixed to lower needle slide member 310 and block 370. FIG. 19 is fixed to lower yarn carrier 212**.

As best shown in FIG. 20, upper yarn carrier slide latching blocks 350, 351, are fixedly mounted, in spaced positions, on upper cam slide member 308 and latches 352, 354 are mounted, in fixed spaced positions, on upper yarn carrier 210. Latch cams 355, 357, are mounted in fixed positions, on fixed base 302. Adjustable latch cam 359 is mounted on adjustable support 321.

As best shown in FIG. 21, lower yarn carrier latches 360, 362 are fixedly mounted, in spaced positions, on lower yarn carrier 212 and lower fixed latch cams 363, 366 are mounted, in fixed spaced positions, on fixed base 302. Lower adjustable latch cam 368 is mounted on adjustable support 321. Lower cam slide member 310 is cut-out at 367, 369, 371 to form lower yarn carrier slide latching blocks 372, 372'. Pin 373, FIGS. 19 and 21, is mounted on lower needle cam slide 310.

With cam carrier 132 and needle cam slide members 308, 310, moving from right to left, FIGS. 19 and 20, when block 182 on needle cam carrier 132 contacts vertical lever 162, rotates lever 162 counter-clockwise around pin 164, the lower end of lever 162 contacts pusher cam ring stop 204 and commences to move pusher cam ring 158 toward the right, FIG. 7B, latch roller **352*a* of latch 352 engages upper fixed latch cam 355, the latch pin of latch 352, to the left of latching block 350, is retracted to clear latch block 350. As needle cam carrier 132 and needle cam slide members continue to move to the left, members 308, 310, fixed to cam carrier 132, continue to move left until pin 335, on upper cam slide member 308, engaged with lever 342, pivots lever 342 counter-clockwise around pivot 344, engaging block 346, fixed to upper yarn carrier 210 and moves upper yarn carrier 210 to the right, as viewed in FIGS. 19 and 20. The movement of upper yarn carrier 210 to the right continues while cam carrier 132 continues to move to the left. As cam carrier ring 132 continues to move left, lever 162 is pivoted, counter-clockwise, around pin 164, the lower end of lever 162 moving pusher cam ring 158** to the right, as has been described.

As upper yarn carrier 210, with upper yarn feeds 330, 332, 334 mounted thereon, is moved to the right by lever 342, lower yarn carrier 212, with lower yarn feeds 336, 338, 340, remains stationary, as later explained.

As needle cam carrier 132 and needle cam slide members 308, 310 continue to move to the left and upper yarn carrier 210, with upper yarn feeds 330, 332, 334, move right, latch 352, with latch **352*a* retracted, moves to the right, clears latch block 350 and upper fixed latch cam block 350 engages the left side of latch 352*a* of latch block 352, needle cam carrier 132 and needle cam slide members 308, 310 reverse direction and commence movement from left to right. As needles 112 commence knitting, upper yarn carrier 210, with upper yarn feeds 330, 332, 334 mounted thereon, move toward the right. All of the foregoing is timed so that, as needles 112 commence knitting, in the movement of needle cam carrier 132 from left to right, yarn feeds 330, 332, 334** are in proper yarn feed position and are moved from left to right as the needles being fed thereby are knitting.

With needle cam slide members 308, 310, moving from the left toward the right, FIGS. 19 and 20, and latches 352, 354, contacting the left sides of blocks 350, 351, respectively, on yarn carrier 210, with yarn feeds 330, 332, 334, mounted thereon, yarn carrier 210 and upper yarn feeds 330, 332, 334 are moved from the right toward the left by needle cam slide 308, 310 until the roller **352*a* of latch 352 contacts latch cam 359 mounted on adjustable support 321, adjusted to a fixed position adjacent the position where yarn knitting is to be transferred from upper yarn feeds 330, 332, 334 to lower yarn feeds 336, 338, 340 to, for example, change the yarn color for intarsia design purposes. Adjustable latch cam 359 engages the roller of latch 352, retracts the latch to disengage block 350. For reasons later apparent, in the space of the feed to one needle thereafter, latch cam 357 mounted on yarn carrier 210 engages roller 354*a* of latch 354**, retracting the latch.

As latch roller **352*a* of latch block 352 is engaged by latch cam 355, stop cam 440, fixed to the end of latch block 352, contacts lever 402, pivotally mounted at 404 on adjustable support 321 and biased in a counter-clockwise direction, FIG. 19, by spring 406, about pivot 404. As the latch of latch block 354 is retracted, stop cam 400 depresses lever 404, moving lever 404 clockwise, FIG. 19, about pivot 404 to depress stop 410 and engage stop 410 with notch 412 of lever 414, stopping further rightward movement of upper yarn carrier 210 and upper yarn feeds 330, 332, 334, as latch cam 357 engages latch roller 354*a* and retracts the latch of latch block 354**.

Referring now to FIG. 20, as adjustable latch cam 359 engages latch roller **352*a* of latch block 352 on upper yarn carrier 210, to retract the latch to disengage block 350 and stop 410 engages notch 412 to stop further rightward movement of upper yarn carrier 210 and upper yarn feeds 330, 332, 334, FIG. 20, lower cam slide member 310, fixed to and moving from right to left in FIGS. 19, 20 and 21, while lower yarn carrier 212 is stationary, engages the right side of lower yarn carrier slide latch block 372', formed between lower cam slide cut-outs 367, 369, with the left side of the latch of latch block 362 and block end 372 of cut-out 371 with the left side of the latch block of latch block 360. Thus, the yarn on the yarn carriers of the upper and lower yarn carriers are both fed to the same needle for knitting as the travel from left to right of the upper yarn carrier 210 and yarn feeds 330, 332, 334 is stopped and the travel or lower yarn carrier 212 and yarn feeds 336, 338, 340, from left to right, FIGS. 19 and 21**, commences.

With the lower yarn carrier 212 and lower yarn feeds 336, 338, 340 traveling from right to left, as lower cam slide member 310 and cam ring 132 reciprocates from left to right, yarn from lower yarn feeds 336, 338, 340 is fed to the knitting needles 112. As yarn is being fed to the last of the knitting needles 112 in such left to right movement of cam slide members 308, 310, lower yarn carrier 212 and lower yarn feeds 336, 338, 340, the right hand end of block 182, FIG. 19, on needle cam carrier 132 contacts vertical lever 168, with its lower end now in contact with pusher cam ring stop 206 and rotates lever 168 clockwise around pin 170. While this is occurring lower fixed latch cams 364, 366 engage rollers 360*a*, 362*a* of latches of lower carrier latches 360, 362, and disengages the latches. As the latches are disengaged, pin 373 on lower cam slide member 310 engages one end of lever 347, FIGS. 19 and 21, pivotally mounted on the lower end of pin 344, pivots lever 347 clockwise around pin 344 and the other end of lever 347, contacting block 380 on lower yarn carrier 212, advancing yarn carrier from the right to the left, in FIGS. 19 and 21, disengaging lower fixed latch cams 364, 366 from the latches of lower carrier latches 360, 366, positioning such latches on the left side of the latch blocks 372, 372' in lower cam slide member 310 for moving lower yarn carrier 212 from left to right and aligning yarn feeds 336, 338, 340 with needles 112 as cam ring 132 is moved for right to left. Latch cam 368, FIG. 21 fixed to adjustable support 321, FIG. 21, engages the roller latch 362*a* of latch block 362 to disengage the latch stop the leftward movement of lower yarn carrier 212 as the yarn feed is transferred from yarn feeds 336, 338, 340 of lower yarn carrier 212 to yarn feed 330, 332, 334 of upper yarn carrier 210, and knitting is continued from right to left.

In the embodiment of the invention shown and described, pushers 1–48, FIG. 5, overlap at their abutting edges. The length of the overlap and the width of one needle groove are substantially the same. Thus, the one needle in the needle groove at the overlapping abutting edge, will be lifted or raised by both pushers, as each pusher is lifted or raised. Such common lifting of the one needle, ending off the knitting by one of the group of needles and starting up the knitting by the next group of needles, interconnects the knitting stitches at the end of the fabric knitted by one needle group with the knitted stitches knitted by the needles of the following needle group. The fabrics are thus joined. Rather than overlapping the abutting edges of the pushers, pushers 1–48 may be abutted without overlapping and the needle cylinder might be racked after each row of stitches is knitted.

In the embodiment of FIGS. 3 and 3A, for purposes of needle cylinder racking, ring gear 240 is fixed to and extends around the inside wall at the bottom of cylinder 100. Pinion gear 242, meshing with ring gear 240, is mounted on shaft 244 of stepper motor 246 mounted, in turn, on cylinder base 101. Bearings 248, 250, are mounted on base 101 and support shaft 244 for rotation. Stepper motor 246 is reversible. By energizing stepper motor 246 in one direction, needle cylinder 100 and needles 112 mounted thereon are racked in one direction relative to pusher 1–48. By energizing stepper motor 246 in opposite direction, the racking is reversed.

Figure 3B:
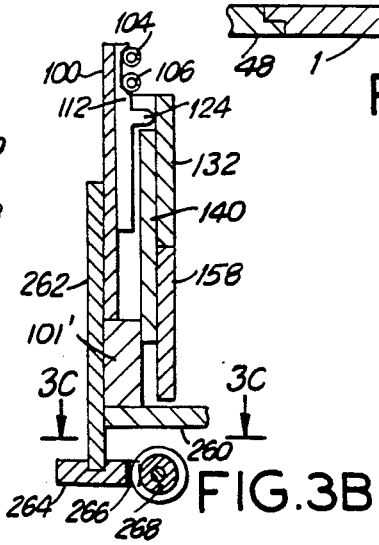
FIG. 3B is a view, similar to FIG. 3A, but showing a second embodiment of a mechanism for indexing the needle cylinder.
Figure 3C:
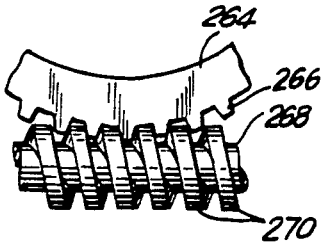
FIG. 3C is a sectional view taken at 3C—3C, FIG. 3B.
Figure 6:
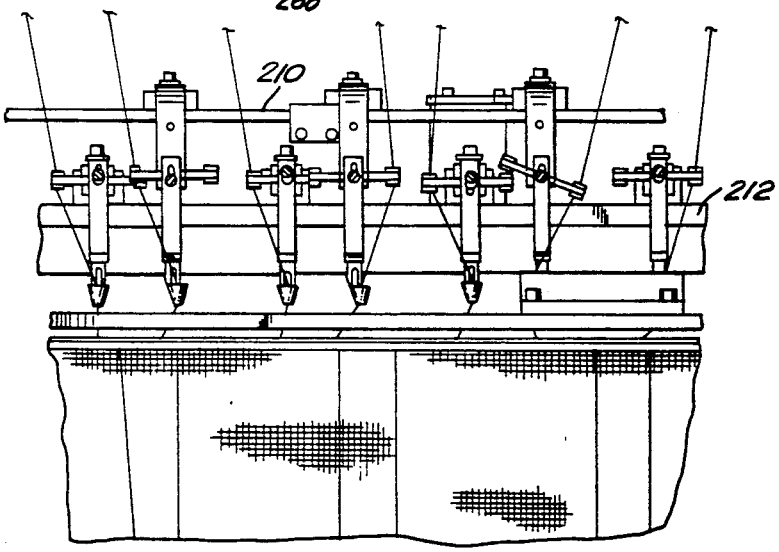
FIG. 6 is fragmentary view, in elevation, of the apparatus of FIG. 1, taken from the inside of the cylinder and looking outwardly.

In the embodiment of FIGS. 3B and 3C, needle cylinder 100 is mounted for racking on fixed cylinder base 101' fixed to support 260, FIG. 3B. Racking control cylinder 262 is fixed, at its upper end, to needle cylinder 100 and, at its lower end, is fixed to ring gear 264 having equally spaced teeth 266 around its periphery. Worm gear 268, having square toothed spiral gear 270 extending axially along its periphery and in mesh with teeth 26 of ring gear 264 is mounted at the periphery of ring gear 264. Teeth 26 of ring gear 264 are fitted to each other so that, in either direction of rotation of worm gear 268, there is no back lash or lost motion between the turning of worm gear 268 and the movement of ring gear 264. Thus, ¼ or 90 Degrees of rotation of worm gear 268, in either direction, will rack control arm 262 and needle cylinder one needle groove width to advance or retract needle cylinder one needle relative to pushers 1–48, depending upon the direction of rotation of the worm gear 268. Worm gear 268 may be turned by a stepper motor, control chain or other means. Other means of racking needle cylinder 100 and needles 112 relative to pushers 1–48 might also be used.

When pusher 1–48, with flush abutting edges are employed and the knitted groups are joined by racking the needle cylinder relative to pushers 1–48, needle cylinder 100 might be racked, in alternating directions, at the end of each knitting course or the racking might be spaced so that a selected number of courses are knitted without racking. Where the racking between courses is spaced, an eyelet will be formed between the knitted courses, the length of the eyelet depending on the number of courses knitted without racking.

In the operation of the apparatus and in the practice of the method of the instant invention and depending upon the design being knitted, the yarn to be knitted can be fed to the needles continuously by one yarn feed mounted on a single yarn carrier or by two yarn feeds, feeding yarn to the needles one yarn feed, after the other, and mounted on separate yarn carriers. In either event, at the end of each direction of travel and as knitting cam ring 132 is changing direction of travel, FIGS. 8 and 14, the angle at which the yarn is fed to the needles is reversed so that, as the needle, with its open hook, is drawn down from the position shown in FIG. 3, the yarn to be knitted will be engaged by open needle hook and drawn down by the needle. This is accomplished by repositioning the yarn feeds, at the opposite ends of the reciprocal feed, as described with reference to FIGS. 19–21, supra., with one two yarn carriers, as described, or at the ends of reciprocation with a single yarn carrier, with reposition of the single carrier at the opposite ends of needle cylinder reciprocation in the manner described.

By selecting the colors of yarn to be fed to the needles by the yarn feeds, a wide variety of intarsia design single knit jersey fabric, in a wide variety of colors, can be knitted. Thus, selected of the groups of needles around the cylinder might be fed with a white or off-white yarn, while other of the groups may be fed with a blue yarn, others with a yellow yarn, others with red yarn and still others with a green yarn. By placing a white, or off-white, yarn group between each color, a jersey fabric having what would appear to be a white, or off-white, background and vertical stripes of the different colors can be knitted. By racking needle cylinder 100, on needle base 102, and the yarn feeds in one direction after each row is knitted and while knitting cam ring 132 is being reversed, the rows or vertical stripes of different colors knitted into the jersey fabric can be knitted diagonally in the fabric. The width of the row or vertical stripe knitted into the fabric depends upon the yarn feed. Thus by providing a single yarn feed to a section made up of two needle groups, the width of the vertical row or stripe knitted into the jersey by such section will correspond to the section width. If two yarns feeds, one for each needle group, are provided, the width of the vertical row or stripe can be knitted to correspond to the width of the needle group. By selecting the number of needles in the needle section, i.e., two needle groups, to be knitted with the yarn from each of the two feeds, one after the other, the width of the row or stripe can be varied. The yarns from the two yarn feeds are joined in the fabric, as discussed with respect to FIGS. 19-21, supra., by commencing the knitting of the yarn from the second yarn feed on the last needle knitted with the yarn from the first yarn feed. By feeding the two yarns to the single needle a double yarn stitch loop is formed to join the fabric. In the instance of two yarns feed in a section, geometric designs, other than stripes, might be knitted.

By providing two yarn carriers to the section, each with its own yarn feed and feeding different color yarn, by racking needle cylinder 100 on cylinder base 102 and also racking the yarn carriers after one or more courses are knitted in the section, diamond intarsia design can be knitted. As racking occurs, the number of needles knitted with the yarn of the yarn feed of one yarn carrier, for example, white yarn, is increased and the number of needles knitted with the yarn of the yarn feed of the other carrier, for example, blue yarn, is decreased. By selectively racking the cylinder each time, in either direction, a chosen number or needles and racking the yarn carriers, a wide variety of intarsia designs in single knit jersey fabric can be knitted with the apparatus and method of the instant invention. For purposes of racking, the yarn carrier might be mounted with a ring gear, pinion and stepper motor, such as ring gear 240, pinion 242 and stepper motor 246, FIG. 3, 3A, ring gear 264 and worm gear 268, FIGS. 3B, 3C or other racking mechanism.

In terms of only racking the cylinder, a number of straight, diagonal and zig-zag stripe designs can be knitted without racking the yarn carrier and without using two yarn feed for the needle section. Where designs in solid color other than stripes, are to be circular knitted in jersey fabric, the cylinder and yarn feed racking, with two yarn feeds for the needle section of the method and apparatus of the instant invention provides knit-in design without needle selection and the relatively expensive machinery and method of the jacquard system. The apparatus of the instant invention is less expensive to build and to maintain and the need for needle jacks, needle selection and complicated controls is eliminated. The process is less complicated and more easily practiced by the knitter.

The terms and expressions which have been employed in the foregoing are used as terms of description and not of limitations, and there is no intention, in the use of such terms and expressions, of excluding any equivalents of the feature shown and described or portions thereof, but it is recognized that various modifications are possible within the scope of the invention claimed.

What is claimed:

1. A method for knitting intarsia design jersey knit fabric on a circular knitting machine having a needle cylinder assembly including parallel needle grooves extending axially of said cylinder, each needle groove having a needle mounted in said groove for axial movement relative to said cylinder, a knitting cam assembly and means for reciprocating the knitting cam assembly relative to the needle cylinder assembly in first and second directions transverse the needles on said needle cylinder, said knitting cam assembly including a plurality of knitting cams spaced around said cylinder assembly, a plurality of pushers mounted on said cylinder for axial movement on said cylinder and forming a ring around said cylinder, each of said pushers, when moved axially on said cylinder toward said needles, simultaneously raising a group of circumferentially contiguous, sequential needles, each of said needles in said raised group of needles being engagable, one after the other in the sequence on said cylinder, by one of said knitting cams on said knitting cam assembly when said knitting cam assembly is reciprocated toward said lifted needles to draw the engaged raised needle down and form a new stitch on said needle and shed the old stitch from such needle and means for feeding yarn to said needles as said needles are drawn down, the steps comprising: actuating the first needle pusher immediately ahead of the knitting cam, in the direction of movement of said cam, to simultaneously raise the group of circumferentially contiguous with the sequential needles in the first needle group in raised position, retracting said first pusher; while retracting said first pusher, moving said knitting cam assembly and said knitting cam relative to said needle cylinder in a first direction toward said raised needles to engage each of said raised needles in said first needle group, one after the other, and draw each of said raised needles down to form a new stitch loop in the needle hook and shed the old stitch from such needle, while moving said knitting cam assembly toward said raised needles in said first needle group and drawing said raised needles down, actuating the second needle pusher in the direction of movement of said cam assembly to simultaneously raise the plurality of needles in the second needle group, with the sequential needles in the second needle group in raised position, retracting the second needle pusher, and, while retracting said second pusher, continuing the movement of said knitting cam assembly and said knitting cam in said first direction toward said raised needles to engage each of said raised needles in said first needle group, one after the other until all of the needles of the first needle group have been drawn down, thereafter continuing said movement of said knitting cam assembly and said knitting cam in said first direction and drawing down each of said raised needles in said second raised needle group to form a new stitch loop in the needle hook and shed the old stitch from such needle until all of the needles of the second needle group have been drawn down, a new stitch loop has been formed in each needle hook, the old stitch has been shed from the needles, the knitting cam has cleared the needles of the second needle group, the second needle pusher has again been actuated to raise the plurality of needles of the second needle group and the needles of the second needle group are in raised position, while said movement in said first direction continues and said knitting cam is clearing said needles of said second group of needles and second group of needles are being raised, repositioning said means for feeding yarn to said needles from a feed position in said first direction to a feed position in a reverse direction, stopping said movement of said knitting cam assembly and said knitting cam in said first direction and reversing the direction of movement of said knitting cam assembly and said knitting cam after the knitting cam has cleared the needles of the second group of needles, the second needle pusher has been actuated and the second group of needles are in raised position.

2. A method, as recited in claim 1, in which the movement of said knitting cam assembly and said knitting cam relative to said needle cylinder assembly is stopped and the direction reversed each time the knitting cam has drawn down and knitted the last of the needles, raised up by the pushers to be knitted, has cleared such needles and the pusher immediately behind said knitting cam, in the direction of movement of said knitting cam when said knitting cam was stopped, has been actuated and the group of needles raised by such pusher are in raised position.

3. A method, as recited in claim 1 or 2, including the further step of repositioning the yarn feed means after all of the raised needles of the first and second groups of needles have been drawn down, new stitch loops have been formed in the hooks of the drawn down needles and the old stitch loops have been shed from such needles so as to feed yarn to the needles when the needles are raised and drawn down in the reverse direction of movement of the knitting cam assembly.

4. A method, as recited in claim 1, including the steps of simultaneously actuating the needle pushers immediately ahead of each of the knitting cams, in the direction of movement of said cams, to simultaneously raise the groups of contiguous sequential needles raised by each of said actuating needle pushers, with the sequential needles in the needle groups in raised position, retracting the actuated pushers, while retracting said actuated pushers, moving said knitting cam assembly and said knitting cams relative to said needle cylinder in a direction toward said raised needles to engage each of said raised needles in said needle groups, one needle in each group after the other, and draw each of said raised needles in said raised groups down to form a new stitch loop in the needle hook and shed the old stitch from each such needle, while moving said knitting cam assembly toward said raised needles in said first needle groups and drawing said raised needles down, simultaneously actuating the needle pushers immediately ahead of each of the knitting cams in the direction of movement of said cam assembly to simultaneously raise the plurality of needles in the next needle groups, with the sequential needles in the next groups of needles in raised position, retracting needle pushers, and, while retracting said pushers, continuing the movement of said knitting cam assembly and said knitting cams relative to said needle cylinder in said raised needles to engage each of the remaining raised needles in said raised needle groups, one needle after the other until all of the needles of the raised needle group have been drawn down, and thereafter drawing down each of said raised needles to form a new stitch loop in the needle hook and shed the old stitch from such needle.

5. A method, as recited in claim 4, including the further steps of continuing the movement of said knitting cam assembly and said knitting cams relative to said needle cylinder assembly until all of the raised needles have been drawn down, a new stitch loop has been formed on each needle hook and the old stitch has been shed from the needle, raised group of needles has been drawn down, reactivating said needle pushers to again simultaneously raise said plurality of needles and, with said needles raised, stopping and reversing the direction of movement of said knitting cam assembly and said knitting cams relative to said needle assembly.

6. A method, as recited in claim 5, including the further steps of; retracting said pushers after said needles have been raised and while said knitting cam assembly and said knitting cams are moving in the reverse direction; while retracting said needle pushers, continuing said reverse movement of said knitting cam assembly and said knitting cams to engage each of said needles in said raised groups of needles, one needle in each such second group after the other, to form a new stitch in the needle hook and shed the old stitch from the needle; while so moving said knitting cam assembly and said knitting cams, simultaneously actuating the needle pushers immediately ahead of each of said knitting cams to simultaneously raise the plurality of needles in the next needle groups; with the sequential needles of said next needle groups in raised position, retracting the actuated pushers; and, while retracting said actuated pushers, continuing said movement of said knitting cam assembly and said knitting cams to engage each of the raised needles, one needle in each such raised needle group after the other, to form a new stitch loop on each such needle and shed the old stitch until all of the raised needles are drawn down, the knitting cams have cleared the needles of the first needle group, the needle pushers immediately ahead of said cams have been actuated and raised to raise the next groups of needles and the movement of said knitting cam assembly and said knitting cams relative to said needle cylinder assembly is stopped and the movement reversed.

7. A method, as recited in claim 6, in which after completion the steps are repeated.

8. A method, as recited in claim 4, 5, 6 or 7, including the further step of feeding a different colored yarn to the yarn feed means at at least one of the yarn feeds at at least one of the knitting cams.

9. A method, as recited in claim 4, 5, 6 or 7, including the further step of repositioning said yarn feed means at the end of each direction of relative movement of the knitting cam assembly and knitting cams with the needle cylinder for feeding said yarn to said needles to be drawn into stitches by said needles during the subsequent reverse direction of movement of said knitting cam assembly and said needle cylinder.

10. A method, as recited in claim 1, 2, 4, 5, 6 or 7, including the further step of racking said needle cylinder and said needles relative to said pushers at the end of relative movement of said knitting cam assembly and said needle cylinder in said first and said second directions.

11. A circular knitting machine for knitting intarsia design jersey fabric comprising, a needle cylinder assembly having parallel needle grooves extending axially of said cylinder, a needle in each needle groove for movement in the needle groove axially of the needle cylinder, a plurality of needle pushers mounted side by side on said needle cylinder below said needles and forming a ring of pushers around said needle cylinder, each of said pushers, when raised on said needle cylinder toward said needles, raising a group of axially contiguous, sequential needles from a drawn down knitted position on said needle cylinder to a raised position, means for raising said pushers to raise said needle groups, a knitting cam assembly extending peripherally around said needle cylinder and mounted for reciprocal movement on said needle cylinder and transverse said needle grooves and said needles, a plurality of knitting cams mounted in fixed position on said knitting cam assembly and spaced on said knitting cam assembly around said needle cylinder for engaging said contiguous, sequential needles, one needle after the other, when said needles are in raised position, to draw such needles, one after the other, down, means for moving said knitting cam assembly and said knitting cams in a first direction relative to said cylinder to draw the raised needles in advance of said cam down into knitted position and then in a reverse second direction relative to said needle cylinder to draw the raised needles in advance of said cam in said reverse direction down into knitted position, means interconnecting said knitting cam assembly moving means and said pusher raising means to raise said pushers and raise said needle groups in advance of the movement of said cams as said knitting cam assembly and said cams are reciprocated in said first and second direction on said needle cylinder, yarn feed means for feeding yarn to said needles as said needles are drawn down into knitted position, said yarn feed means including yarn feed carrier means connected to said knitting cam assembly for repositioning said yarn carrier means and said yarn feed means as the direction of movement of said knitting cam assembly is reversed.

12. A circular knitting machine, as recited in claim 11, including means for holding said needles in raised position on said needle cylinder when raised by said pusher and said pusher is lowered and for releasing said needles, one after the other, when said needles are drawn down by said knitting cams.

13. A circular knitting machine, as recited in claim 12, in which said means for holding said needles in raised position includes a groove in each needle and spring means on said cylinder for engaging said needle groove when said needles are raised by said pushers.

14. A circular knitting machine, as recited in claim 11, in which said means for raising said pushers includes pusher cam means, means for grouping said pushers around said needle cylinder into two groups of alternating pushers and means for actuating said pusher cam means for simultaneously raising and lowering the pushers of one group independent of the pushers of the other group and for simultaneously raising and lowering the pushers of said other group independent of the pushers of said one group.

15. A circular knitting machine, as recited in claim 14, in which said means for actuating said pusher cam means includes means for simultaneously raising and then lowering the pushers of said one group of pushers and then simultaneously raising and then lowering the pushers of said other group of pushers for movement of said knitting cams in said first direction around said cylinder and for simultaneously raising and then lowering the pushers of said other group of pushers and then simultaneously and then lowering the pushers of said one group of pushers for movement of said knitting cams in said reverse second direction of movement around said cylinder.

16. A circular knitting machine, as recited in claim 15, in which said means for actuating said pusher cam means includes means for simultaneously raising the pushers of said one group of pushers immediately after said knitting cams have drawn down the needles raised by said one group of pushers, are completing movement in said reverse second direction and said knitting cams start movement in said first direction around said cylinder.

17. A circular knitting machine, as recited in claim 16, in which said means for actuating said pusher cam means includes means for simultaneously raising the pushers of said other group of pushers immediately after said knitting cams have drawn down the needles raised by said other group of pushers, are completing movement in said first direction and said knitting cams start movement in said reverse second direction around said cylinder.

18. A circular knitting machine, as recited in claim 11, 12, 13, 14, 15, 16 or 17, including means for racking said needle cylinder and said needles relative to said pushers at the ends of movement of said knitting cams relative to said needle cylinder in said first direction and in said reverse second direction.

* * * * *